US006769281B2

(12) United States Patent
Irie et al.

(10) Patent No.: US 6,769,281 B2
(45) Date of Patent: Aug. 3, 2004

(54) METHOD AND APPARATUS OF PRODUCING A COLUMNAR MEMBER CONTAINER

(75) Inventors: Tohru Irie, Nagoya (JP); Masashi Ota, Kariya (JP)

(73) Assignee: Sango Co., Ltd., Nagoya (JP)

( * ) Notice: Subject to any disclaimer, the term of this patent is extended or adjusted under 35 U.S.C. 154(b) by 0 days.

(21) Appl. No.: 10/375,096

(22) Filed: Feb. 28, 2003

(65) Prior Publication Data

US 2003/0167854 A1 Sep. 11, 2003

(30) Foreign Application Priority Data

| | | |
|---|---|---|
| Mar. 5, 2002 | (JP) | 2002-058544 |
| Aug. 19, 2002 | (JP) | 2002-238526 |
| Jan. 28, 2003 | (JP) | 2003-018305 |

(51) Int. Cl.[7] ..... B21D 3/02; B21D 51/16

(52) U.S. Cl. ..... 72/121; 29/890

(58) Field of Search ..... 72/121; 29/890, 29/515; 73/818

(56) References Cited

U.S. PATENT DOCUMENTS

| | | | | |
|---|---|---|---|---|
| 5,055,274 A | | 10/1991 | Abbott | |
| 5,118,476 A | | 6/1992 | Dryer et al. | |
| 5,329,698 A | | 7/1994 | Abbott | |
| 5,724,735 A | | 3/1998 | Ickes et al. | |
| 5,755,025 A | | 5/1998 | Wirth et al. | |
| 5,782,089 A | * | 7/1998 | Machida et al. | 422/179 |
| 5,787,584 A | * | 8/1998 | Shea et al. | 29/890 |
| 5,829,132 A | | 11/1998 | Sickels et al. | |
| 5,901,595 A | * | 5/1999 | Massee | 72/81 |
| 5,980,837 A | | 11/1999 | Umin et al. | |
| 6,018,972 A | | 2/2000 | Irie | |
| 6,067,833 A | | 5/2000 | Irie | |
| 6,086,829 A | * | 7/2000 | Shea et al. | 422/179 |
| 6,162,403 A | * | 12/2000 | Foster et al. | 422/173 |
| 6,162,404 A | | 12/2000 | Tojo et al. | |
| 6,216,512 B1 | | 4/2001 | Irie | |
| 6,233,993 B1 | | 5/2001 | Irie | |
| 6,317,976 B1 | | 11/2001 | Aranda et al. | |
| 6,381,843 B1 | | 5/2002 | Irie et al. | |
| 6,389,693 B1 | | 5/2002 | Aranda et al. | |
| 6,591,498 B2 | | 7/2003 | Irie et al. | |
| 6,701,617 B2 | * | 3/2004 | Li et al. | 29/890 |

FOREIGN PATENT DOCUMENTS

| | | |
|---|---|---|
| EP | 0 681 095 B1 | 11/1995 |
| EP | 0 982 480 A2 | 3/2000 |
| JP | A 64-60711 | 3/1989 |
| JP | A 2-268834 | 11/1990 |

(List continued on next page.)

*Primary Examiner*—Edward Lefkowitz
*Assistant Examiner*—T. Miller
(74) *Attorney, Agent, or Firm*—Oliff & Berridge, PLC

(57) ABSTRACT

The present invention is directed to a method of producing a container for holding a columnar member in a cylindrical housing with a shock absorbent member wrapped around the columnar member. The method comprises the steps of (1) compressing at least a part of the absorbent member wrapped around the columnar member, by a pushing member in a radial direction toward the longitudinal axis, (2) measuring a pressure applied to the absorbent member by the pushing member, (3) measuring a distance between the axis of the columnar member and an end of the pushing member contacting the absorbent member, when the measured pressure substantially equals a predetermined target pressure, to provide a target radius, (4) inserting the columnar member and the absorbent member into the housing loosely, and (5) reducing a diameter of the housing along its longitudinal axis, with the absorbent member being compressed, to such an extent that the inner radius of the housing substantially equals the target radius, to hold the columnar member and the absorbent member compressed at the target pressure, in the housing.

19 Claims, 18 Drawing Sheets

FOREIGN PATENT DOCUMENTS

| | | |
|---|---|---|
| JP | A 8-42333 | 2/1996 |
| JP | A 9-170424 | 6/1997 |
| JP | A 9-234377 | 9/1997 |
| JP | B2 2957153 | 7/1999 |
| JP | B2 2957154 | 7/1999 |
| JP | A 2000-45762 | 2/2000 |
| JP | A 2001-107725 | 4/2001 |
| JP | A 2001-137962 | 5/2001 |
| JP | A 2001-355438 | 12/2001 |
| JP | A 2002-97944 | 4/2002 |
| JP | A 2002-201932 | 7/2002 |
| JP | A 2002-263764 | 9/2002 |
| WO | WO 02/04167 A1 | 1/2002 |
| WO | WO 02/24297 A2 | 3/2002 |
| WO | WO 02/095198 A1 | 11/2002 |

* cited by examiner

METHOD AND APPARATUS OF PRODUCING A COLUMNAR MEMBER CONTAINER

BACKGROUND OF THE INVENTION

1. Field of Invention

The present invention relates to a method of producing a container for holding a columnar member in a cylindrical housing, with a shock absorbent member wrapped around the columnar member, and more particularly a method of producing a catalytic converter for holding a catalyst substrate with a shock absorbent mat wrapped around it in a cylindrical housing, and relates to an apparatus of producing the same.

2. Description of Related Arts

A container for holding a columnar member having a honeycomb structure and functioning as a fluid filter in a metallic cylindrical housing through a shock absorbent member has been used for a fluid treatment device, and provided for purifying various fluids. In an exhaust system of an automotive vehicle, for example, a catalytic converter, a diesel particulate filter (abbreviated as DPF) and the like have been used, and equipped with a fragile ceramic columnar member of a honeycomb structure, for a catalyst substrate, filter or the like (hereinafter, referred to as catalyst substrate). The honeycomb columnar member is held in the metallic cylindrical housing thorough the shock absorbent member such as a ceramic mat or the like, to constitute the fluid treatment device, an example of which is the catalytic converter. In order to produce the container for holding the columnar member such as the catalytic converter, generally employed is such a method for wrapping the shock absorbent member around the catalyst substrate, and stuffing them into the cylindrical housing, with the shock absorbent member being compressed.

For example, Japanese Patent Laid-open Publication No. 2001-355438 proposes a method of producing a catalytic converter, by measuring the outer diameter of a catalyst substrate, when the catalyst substrate with a holding material mounted around its periphery is stuffed (pressed) into a holding cylinder, and then stuffing the catalyst substrate with the holding material mounted thereon into the holding cylinder with its inner diameter adapted for the measured outer diameter. Also, it is proposed to measure the outer diameter of the holding material mounted on the catalyst substrate, and stuff the catalyst substrate with the holding material mounted thereon into the holding cylinder with its inner diameter adapted for the measured outer diameter. Furthermore, it is proposed to measure the outer diameter of the holding material in such a state that a certain pressure is applied to the holding material. It is also proposed to select a holding cylinder having a proper inner diameter, out of a plurality of holding cylinders with various inner diameters different from one another, which were provided in advance.

In contrast, it is proposed such a method called as "sizing" or "calibrating", wherein after the catalyst substrate and a shock absorbent mat mounted thereon were inserted into a cylindrical member, the diameter of the cylindrical member is reduced until the shock absorbent mat will be compressed to the most appropriate compressed amount, as disclosed in Japanese Patent Laid-open Publication Nos. 64-60711, 8-42333, 9-170424, 9-234377, U.S. Pat. Nos. 5,329,698, 5,755,025, 6,389,693, and European Patent Publication No. EP0982480A2 and so on. Among them, in Japanese Patent Laid-open Publication No. 9-234377, it is proposed to reduce a casing along its entire longitudinal length, in order to solve a problem in its prior art as disclosed in Japanese Patent Laid-open Publication No. 2-268834. In the former Publication, it is stated about the latter Publication that there is disclosed a catalytic converter with a central portion of a tubular body reduced in diameter to form a compressed portion, and compress a support mat to support a ceramic honeycomb body in the casing. And, it is stated in the former Publication that the above problem will be caused, as a clearance between the outer circumference of the honeycomb body and the inner circumference of the casing is large in a direction from an end of the compressed portion toward cone portions which are not reduced in diameter.

In the U.S. Pat. No. 5,755,025, a process for manufacturing catalytic converters is proposed, as described in its abstract, by pushing monoliths and a surrounding support jacket into prefabricated tubes, whose cross section essentially corresponds to the profile of the monolith plus an addition for the support jacket. In the abstract, it is described that the dimensions of the tube (housing) are adapted to a constant gap(s) from the monolith by sizing (calibrating) the prefabricated tubes which initially have a smaller cross section. Thus, substantially the same process as stuffing the substrate and mat into the housing as described before has been employed. Furthermore, in the U.S. Pat. No. 6,389,693, a method of manufacturing a catalytic converter is proposed, by resizing a container over substantially the entire portion of its length which is occupied by the wrapped substrate to a predetermined metal shell/container outside diameter (OD). The predetermined outside diameter is characterized by the equation OD=D+2T1+2T2, wherein "D" is a diameter measure of the substrate, "T1" is the supporting mat target thickness and "T2" is a container wall thickness measure. Likewise, in the European Patent Publication No. EP0982480A2, it is described in its abstract that the subsequent to loading a mat and substrate into a can, the measurement of the substrate is used to direct the degree to which the can is reduced in outside dimension such that a selected annulus is created between the substrate and can, the annulus being occupied by the mat.

With respect to Japanese Patent Laid-open Publication No. 2000-45762 cited in Japanese Patent Laid-open Publication No. 2001-355438, a method for reducing a cylindrical member by a spinning process. Furthermore, there is disclosed in Japanese Patent Laid-open Publication No. 2001-107725, a method for producing a catalytic converter by reducing a diameter of a cylindrical member with a shock absorbent member held therein to hold a substrate catalyst, according to a spinning process using a plurality of spinning rollers revolved about the cylindrical member. As for a necking process applied to an end portion of the cylindrical member, an offset spinning process is disclosed in Japanese Patent No. 2957153, and an oblique spinning process is disclosed in Japanese Patent No. 2957154. And, a spinning apparatus is disclosed in Japanese Patent Laid-open Publication No. 2001-137962.

In the Japanese Patent Laid-open Publication No. 2001-355438 as described above, it is described that it is preferable to measure the outer diameter of the holding material, in such a state that the holding material 3 is applied with the same pressure (holding pressure) as the pressure which will be applied to the holding material 3 when the catalyst substrate 2 is stuffed into (pressed into) the holding cylinder 1. According to the method as described above, however, it is impossible to estimate the pressure which will be applied to the holding material in the later process, and no explanation about this matter has been described. Therefore, the above description that the holding material 3 is applied with the same pressure as the pressure which will be applied to the holding material 3 when the catalyst substrate 2 is pressed into the holding cylinder 1, is merely a desire or hope, and nothing is disclosed to show that it will be possibly realized. In addition, it is described that as for a base member of the holding cylinder 1, used is the one having its inner diameter which will enable to have the stuffed holding material 3 apply the appropriate pressure to the catalyst substrate 2. It is also stated that it can be achieved to select the one having the appropriate inner diameter, out of a plurality of base members having different inner diameters from one another prepared in advance. Therefore, it is apparent that the holding cylinder 1 is not the one having its inner diameter to be adjusted in accordance with the result of the measurement of the outer diameter of the holding material 3, in the state that the holding material 3 is applied with the same pressure as the pressure which will be applied to the holding material 3 when stuffed into the holding cylinder 1, which measurement can not be made in fact, as described above. After all, it is not clear in the Japanese Patent Laid-open Publication No. 2001-355438, how the outer diameter of the holding material 3 is measured, in what state the pressure applied to it, nor how and what type of the measured result is used.

On the contrary, according to the conventional method by the stuffing process, on the basis of density of a shock absorbent mat served as the shock absorbent member, which is called as GBD (abbreviation of gap bulk density), an annular clearance between the outer diameter of the catalyst substrate and the inner diameter of the cylindrical housing is determined, in general. The GBD is the value obtained from [weight per unit area/bulk gap]. According to the bulk density of the shock absorbent mat, pressure (Pascal) is created to hold the catalyst substrate. The pressure has to be adjusted to a value which will not exceed the strength of the catalyst substrate, and to a value which is capable of holding the catalyst substrate applied with vibration and exhaust gas pressure not to be moved in the cylindrical housing. Therefore, the shock absorbent member (shock absorbent mat) is required to be stuffed to create the GBD within a predetermined design range, and the GBD is required to be maintained for a life cycle of the product.

According to the conventional method by the stuffing process as described above, however, an error in the outer diameter of the catalyst substrate necessarily caused when producing it, an error in the inner diameter of the cylindrical housing, and an error in weight per unit area of the shock absorbent mat disposed between them are added to create an error in GBD. Therefore, it can not be a practical solution for mass-production to find a combination of each member adapted to minimize the error in GBD. Furthermore, the GBD itself is varied depending upon the property or individual difference of the shock absorbent mat. And, the GBD relies on the value measured on a flat plane, so that it does not indicate the value measured in the case where the shock absorbent mat is tightly wrapped around the catalyst substrate. Accordingly, it has been desired to stuff the catalyst substrate properly into the cylindrical housing, without relying on the GBD.

On the contrary, according to the conventional sizing method, it is proposed to measure the outer diameter of the catalyst substrate and the inner diameter of the cylindrical housing in advance, to determine an appropriate compression amount for the shock absorbent member, and then reduce the diameter by the determined compression amount. However, it is difficult to determine whether the final compression amount is appropriate or not, because the errors of each catalyst substrate and each shock absorbent member are added, and the thickness of each shock absorbent member wrapped around each catalyst substrate is varied. In addition, the difficulty results from the fact that when reducing the diameter of the metallic cylindrical member, it is required to reduce the diameter slightly smaller than a target diameter (so called overshooting), in view of a spring back of the cylindrical member. As a result, excessive compression force might be created. Also, the difficulty is resulted from the fact that when reducing the diameter of the metallic cylindrical member, unavoidable change in thickness of its wall is caused, i.e., the wall thickness is increased when reducing the diameter. Consequently, it is so difficult to determine a true inner diameter (position of inner wall surface), i.e., accurate reducing amount, that the mass-production can not be realized.

In order to solve the problem caused by the overshooting or the like as described above, such a method for measuring the outer diameter of the catalyst substrate in advance, and reducing the diameter of the housing on the basis of the compression amount or target thickness of the shock absorbent mat has been proposed, in the U.S. Pat. Nos. 5,755,025, 6,389,693 and European Patent Publication No. EP0982480A2 as cited before. However, nothing is considered about the various errors caused with respect to the shock absorbent mat including the error in weight per unit area of the shock absorbent mat as described before. Therefore, the ultimate problem about the error in pressure applied to the catalyst substrate can not be avoided, as will be explained in detail hereinafter. At the outset, with respect to a holding force for holding the catalyst substrate in a predetermined position within the cylindrical housing, the holding force in a radial direction of the cylindrical housing corresponds to the pressure reproduction force of the shock absorbent member acting on the outer surface of the catalyst substrate and the inner surface of the cylindrical housing, in a direction perpendicular to those surfaces. On the other hand, with respect to the cylindrical housing fixed to the exhaust system for the automotive vehicle, for example, the catalyst substrate and shock absorbent member are applied with force in their axial directions, due to vibration or exhaust gas pressure. In opposition to the axial force, a holding force is required for them in the axial (longitudinal) direction of the cylindrical housing, which holding force is created by first frictional force between the shock absorbent member and the catalyst substrate, and second frictional force between the shock absorbent member and the cylindrical housing.

The first and second frictional forces are indicated by the product of multiplying the pressure reproduction force of the shock absorbent member and the static coefficient of friction between the shock absorbent member and the outer surface of the catalyst substrate, and the product of multiplying the pressure reproduction force of the shock absorbent member and the static coefficient of friction between the shock absorbent member and the inner surface of the cylindrical housing, respectively. In this respect, as for the holding force in the axial (longitudinal) direction of the cylindrical housing, the frictional force between the shock absorbent member and the remaining one with the smaller coefficient of friction is dominant. With respect to the catalyst substrate and cylindrical housing with known static coefficients of friction, therefore, frictional forces are made clear. In order to ensure the requisite frictional forces, it is required to increase the pressure applied to the shock absorbent member. In the case where the catalyst substrate is fragile, it is required to ensure the axial holding force within the pressure limit to the shock absorbent member, to avoid excessive radial load applied to the catalyst substrate.

Accordingly, it is preferable to determine the pressure applied to the shock absorbent member, on the basis of the one with the smaller static coefficient of friction, out of the static coefficient of friction of the outer surface of the catalyst substrate and the static coefficient of friction of the inner surface of the cylindrical housing, and reduce the diameter of the cylindrical housing. In other words, when holding the catalyst substrate in the cylindrical housing with the shock absorbent member disposed between them, most appropriate parameter is the pressure (Pascal) applied to the catalyst substrate (or, filter) through the shock absorbent member (shock absorbent mat). If it is possible to measure the pressure directly, or measure a value directly corresponding to, or similar to, the pressure, and reduce the diameter of the cylindrical housing on the basis of one of the measured results, then it is possible to reduce the diameter of the cylindrical housing by a sizing process, with satisfactory accuracy. The sizing process means reducing the diameter of the cylindrical housing, controlling the reduced amount, and is distinguished from mere shrinking process for simply reducing the diameter of pipe, which may fall within the same category as that in the sizing process in terms of the process for reducing the diameter of the cylindrical housing.

On the contrary, in the prior methods, generally employed is a control on the basis of the GBD of shock absorbent member (mat) as described before, so that a control through an estimation on the basis of a substituted value has been employed. Therefore, those estimated factors are added together to cause the unavoidable error. Also, the holding force that is caused by the frictional force between the shock absorbent member and catalyst substrate, and the holding force that is caused by the frictional force between the shock absorbent member and cylindrical housing, are eventually confused with each other, to determine the dimensions of each parts. In the measurement as described in the Japanese Patent Laid-open Publication No. 2001-355438 as described before, the estimated factors for the following processes are necessarily added together to cause the error, against which countermeasures will be required.

Especially, in the filed of the catalytic converter, it is desirable that the pressure of the shock absorbent mat is made as strong as possible, and applied uniformly in the peripheral and axial directions, in view of the variation or aged change in pressure resulted from the error in the outer diameter of the catalyst substrate, or the pressure (whose minimum pressure is indicated by a) for preventing the catalyst substrate from moving in the axial direction of the catalyst substrate due to various accelerations when in use. If the compression force is provided to be excessive so as to satisfy the desire as described above, the catalyst substrate might be fractured, so that the pressure can not be made greater than a predetermined pressure. The pressure that is applied when the catalyst substrate is fractured, is called as isostatic strength $\beta$. Furthermore, in response to recent requirement of further improvement in exhaust purifying performance, further reduction in wall thickness has been required, so that the catalyst substrate is getting much more fragile than the prior catalyst substrates, i.e., large reduction in $\beta$, a range for allowing the holding force to be set, which can be indicated by a fracture margin to the pressure ($\beta-\alpha$), will be further narrowed.

Furthermore, increase in temperature of the exhaust gas (temperature of the gas fed into the catalytic converter) will be caused to reach approximately 900 degrees centigrade, so that it is required to combine the shock absorbent mat with alumina mat having a high temperature resistance. However, as the alumina mat does not have thermal expansion property, it is difficult to conform the alumina mat to a change in shape of the metallic container having thermal expansion property. In view of this, the minimum pressure $\alpha$ is required to be set larger than that set for the conventional process, and the bulk density of the shock absorbent mat is required to be set relatively large. Recently, therefore, it is likely that the reduction in $\beta$ and increase in $\alpha$ will result in a large reduction in the pressure allowance range ($\beta-\alpha$), which will be described later in detail with reference to FIG. 28. In other words, accurate determination of the pressure is requisite for each product, to result in difficulty in mass-production of the catalytic converter. In addition, recent progress in narrowing the wall thickness of the catalyst substrate for use in the catalytic converter causes the pressure allowance range ($\beta-\alpha$) to be approximately half of the prior range, and it is estimated that further narrowing the wall thickness will cause it to be approximately half of the present range. As can be seen from those narrow ranges, it is apparent that it will be very difficult to fit such thin wall catalyst substrate into the cylindrical housing by means of the prior stuffing process or the like, maintaining the appropriate pressure to be applied.

SUMMARY OF THE INVENTION

Accordingly, it is an object of the present invention to provide a method and an apparatus of producing a container for holding a columnar member in a cylindrical housing, with a shock absorbent member wrapped around the columnar member, to achieve an appropriate sizing process to the cylindrical housing on the basis of the pressure applied to the columnar member by a compression reproduction force of the compressed shock absorbent member, thereby to hold the columnar member with the shock absorbent member wrapped around it in the cylindrical housing, appropriately.

And, it is another object of the present invention to provide a method and an apparatus capable of producing a container for holding a columnar member in a cylindrical housing, properly adjusted to a change in wall thickness and spring back of the cylindrical housing, which are resulted from reducing a diameter of the cylindrical housing when sizing it.

In accomplishing the above and other objects, the method comprises the steps of (1) compressing at least a part of the shock absorbent member wrapped around the columnar member, by a pushing member in a radial direction toward a longitudinal axis of the columnar member, (2) measuring a pressure applied to the shock absorbent member by the pushing member, (3) measuring a distance between the axis of the columnar member and an end of the pushing member contacting the shock absorbent member, when the measured pressure substantially equals a predetermined target pressure, to provide a target radius, (4) inserting the columnar member with the shock absorbent member wrapped around the columnar member, into the cylindrical housing loosely, and (5) reducing a diameter of at least a part of the cylindrical housing with the shock absorbent member held therein along the longitudinal axis of the cylindrical housing, with the shock absorbent member being compressed, to such an extent that the inner radius of the part of the cylindrical housing substantially equals the target radius, to hold the columnar member with the shock absorbent member wrapped around the columnar member and compressed at the target pressure, in the cylindrical housing.

In the method as described above, preferably, the target pressure is determined on the basis of a static coefficient of friction of the outer surface of the columnar member, and a static coefficient of friction of the inner surface of the cylindrical housing, and pushing force of the pushing member applied to the shock absorbent member.

In the method as described above, a plurality of pushing members may be placed around the periphery of the columnar member in parallel with the longitudinal axis thereof, and at least one of the pushing members may compress the shock absorbent member wrapped around the columnar member in the radial direction toward the longitudinal axis of the columnar member, to measure the pressure applied to the shock absorbent member.

Preferably, the plurality of pushing members comprise a plurality of elongated members, each having a length corresponding to the part of the cylindrical housing with the shock absorbent member held therein, and wherein the plurality of elongated members are placed in parallel with one another around the periphery of the shock absorbent member wrapped around the columnar member.

In the method as described above, preferably, a predetermined amount of correction is provided on the basis of at least one of a change in diameter and a change in thickness of the cylindrical housing when the diameter of the cylindrical housing is reduced, and the reducing amount of the cylindrical housing is adjusted according to the amount of correction, when the diameter of the cylindrical housing with the shock absorbent member held therein is reduced.

And, the amount of correction may be provided by measuring a limit radius of the cylindrical housing, when the shock absorbent member is compressed by the pushing member to such an extent that the inner radius of at least the part of the cylindrical housing is reduced to be less than the target radius and immediately before the columnar member will be fractured, and setting a predetermined distance less than a difference between the limit radius and the target radius, as the amount of correction.

As for the apparatus of producing a container for holding a columnar member in a cylindrical housing with a shock absorbent member wrapped around the columnar member, it includes a compression device having a plurality of elongated pushing members, each having a length corresponding to at least a part of the cylindrical housing with the shock absorbent member held therein, and being placed in parallel with one another around the periphery of the shock absorbent member wrapped around the columnar member, and compressing at least the part of the shock absorbent member wrapped around the columnar member, by the pushing members in a radial direction toward a longitudinal axis of the columnar member. The apparatus further includes a measuring device for measuring a pressure applied to the shock absorbent member by the pushing members, and measuring a distance between the axis the columnar member and an end of at least one of the pushing members contacting the shock absorbent member, when the measured pressure substantially equals a predetermined target pressure, to provide a target radius, and a control device for inserting the columnar member with the shock absorbent member wrapped around the columnar member into the cylindrical housing loosely, and driving the compression device to reduce a diameter of at least the part of the cylindrical housing with the shock absorbent member held therein along the longitudinal axis of the cylindrical housing, by the pushing members, to such an extent that the inner radius of the part of the cylindrical housing substantially equals the target radius, to hold the columnar member with the shock absorbent member wrapped around the columnar member and compressed at the target pressure in the cylindrical housing.

As an embodiment of the columnar member container, a catalytic converter for use in an automotive vehicle is produced. Or, a diesel particulate filter (DPF) may be produced. With respect to the catalytic converter, the columnar member corresponds to a catalyst substrate, e.g., the substrate of a honeycomb structure, and the shock absorbent member corresponds to a shock absorbent mat for holding the substrate. With respect to the DPF, the columnar member corresponds to a filter, and the shock absorbent member corresponds to a shock absorbent mat for holding the filter. In general, the substrate or filter corresponding to the columnar member is formed into a column with a circular cross section or a cylinder. According to the present invention, however, the columnar member includes the one with a noncircular cross section, such as elliptic cross section, oval cross section or the like. In this case, a half of the mean value of its major axis and minor axis may be served as the radius of the cylindrical housing according to the present invention.

BRIEF DESCRIPTION OF THE DRAWINGS

The above stated object and following description will become readily apparent with reference to the accompanying drawings, wherein like reference numerals denote like elements, and in which.

DESCRIPTION OF THE PREFERRED EMBODIMENTS

Figure 1:
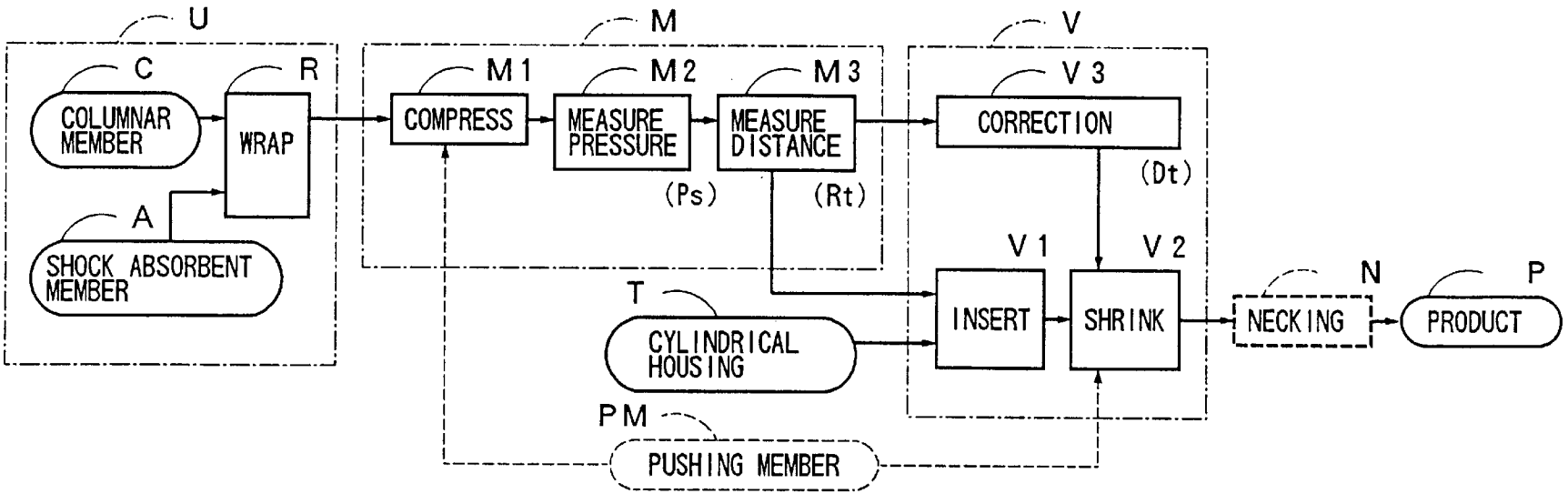
FIG. 1 is a block diagram showing an overall structure for a method of producing a columnar member container, according to the present invention.

Referring to FIG. 1, there is schematically illustrated an overall structure for a method of producing a container for holding a columnar member in a cylindrical housing with a shock absorbent member wrapped around the columnar member, according to the present invention. As an embodiment of the method and an apparatus of producing the same, a method and an apparatus of producing a catalytic converter for use in an exhaust gas purifying system will be explained later with reference to FIGS. 2–18. In FIG. 1, at the outset, according to a unitizing process (U), a shock absorbent member (A) is wrapped around a columnar member (C), as indicated by (R) in FIG. 1, which is achieved separately in general. With respect to a united product (indicated by 1 in FIG. 2) with the shock absorbent member (A) wrapped around the columnar member (C), a measurement process (M) is achieved as follows.

According to the measurement process (M), at least a part of the shock absorbent member (A) wrapped around the columnar member (C), is compressed by a pushing member (PM) as indicated by a broken line in FIG. 1, in a radial direction toward a longitudinal axis of the columnar member (C) at the compression process (M1). Then, the pressure (Ps) applied by the pushing member (PM) to the shock absorbent member (A) is measured in a pressure measurement process (M2). Furthermore, according to a distance measurement process (M3), a distance between the axis of the columnar member (C) and an end of the pushing member (PM) contacting the shock absorbent member (A), when the measured pressure substantially equals a predetermined target pressure (Pt), to provide a target radius (Rt). Although those processes (M1–M3) are shown sequentially for the sake of convenience, they are achieved almost simultaneously, as will be described later with reference to FIG. 3.

Next, the process proceeds to a sizing process (V), wherein according to an inserting process (V1), the columnar member (A) with the shock absorbent member (A) wrapped around the columnar member (C), is inserted into the cylindrical housing (T) loosely. Then, according to a reducing process (V2), a diameter of at least a part of the cylindrical housing (T) with the shock absorbent member (A) held therein along the longitudinal axis of the cylindrical housing (T), is reduced, with the shock absorbent member (A) being compressed, to such an extent that the inner radius of the part of the cylindrical housing (T) substantially equals the target radius (Rt), to hold the united product of the columnar member with the shock absorbent member (A) wrapped around the columnar member (C) and compressed at the target pressure (Pt), in the cylindrical housing (T). Those processes (V1–V3) have been divided for the sake of convenience. Therefore, they are not necessarily required to be achieved separately, and they may be achieved as a consecutively controlled sizing process.

Furthermore, it may be so constituted that according to a correction setting process (V3), a predetermined amount of correction (ds, dt) is provided on the basis of at least one of a change in diameter and a change in wall thickness of the cylindrical housing (T) when the diameter of the cylindrical housing (T) is reduced, and that the reducing amount of the cylindrical housing (T) is adjusted according to the amount of correction, when the diameter of the cylindrical housing (T) with the shock absorbent member (A) held therein is reduced. Consequently, in the case where the spring back of the cylindrical housing (T) is caused after the diameter of the cylindrical housing (T) was reduced, and the case where the wall thickness of the cylindrical housing (T) is increased when the diameter of the cylindrical housing (T) is reduced, the radius of the cylindrical housing (T) will be controlled to be less than a limit radius, to provide the substantially same radius as the target radius (Rt).

In the case where the amount of correction (ds) is provided on the basis of the diameter of the cylindrical housing (T), according to the aforementioned measurement process (M), a limit radius of the cylindrical housing (T) may be measured in advance, when the shock absorbent member (A) is compressed by the pushing member (PM) to such an extent that the inner radius of at least the part of the cylindrical housing (T) is reduced to be less than the target radius (Rt) and immediately before the columnar member (C) will be fractured. And, according to the correction setting process (V2), a predetermined distance less than a difference between the limit radius and the target radius, may be set as the amount of correction (ds). Consequently, especially in the case where the spring back of the cylindrical housing (T) is caused after the diameter of the cylindrical housing (T) was reduced, the radius of the cylindrical housing (T) will be controlled to provide the substantially same radius as the target radius (Rt).

Figure 26:
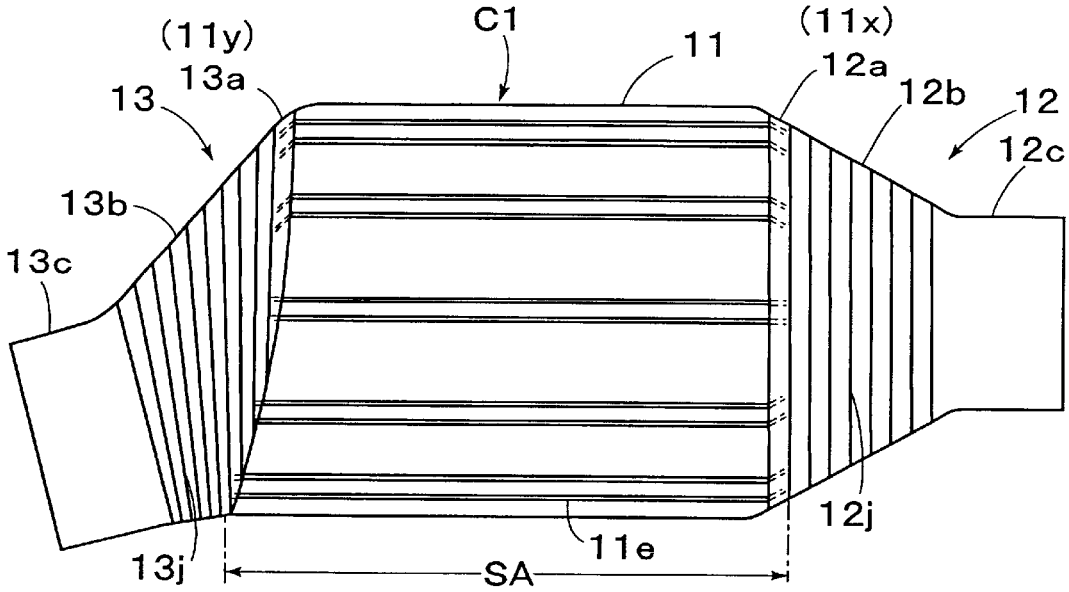
FIG. 26 is a side view showing an example of a finished catalytic converter produced according to an embodiment of the present invention.

If necessary, the process may further proceed to a necking process (N), where open end potions of the cylindrical housing are applied with the necking process to form a finished product (P), e.g., the catalytic converter as shown in FIG. 26. If the pushing member used in the compression process (M1) and the pushing member used in the reducing process (V2) are constituted by the same member, and can be compressed by a common compression device, the measurement process (M) and sizing process (V) can be achieved consecutively by a single device, as will be described later in detail. The measurement process (M) and sizing process (V) are not necessarily achieved consecutively, and may be achieved at different timings and places. For example, it may be so arranged that the united product 1 is measured at a first factory, and inserted into the cylindrical housing (T) at a second factory. Or, an additional process such as the other process for working on the cylindrical housing (T) for example, may be introduced between the measurement process (M) and sizing process (V). In either case, the measured result of the measurement process (M) may be used at the sizing process (V), as will be described later in detail.

Figure 2:
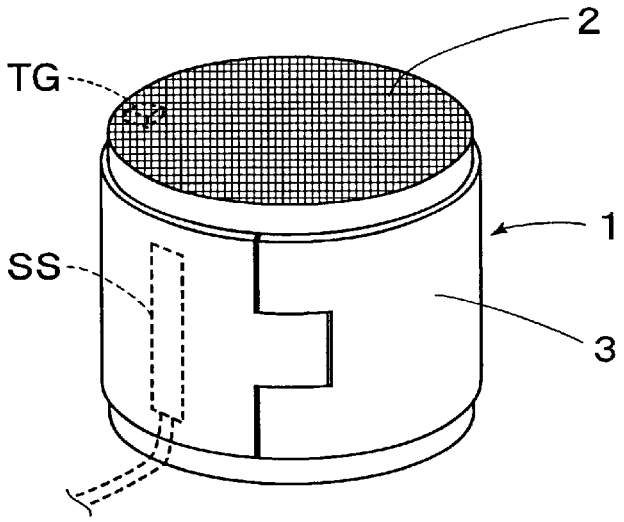
FIG. 2 is a perspective view of a catalyst substrate and a shock absorbent mat wrapped around it in a catalytic converter as an object to be produced by the method according to embodiments of the present invention.

Next, as an embodiment of the method of producing the columnar member container, a method (and apparatus) of producing the catalytic converter will be explained. At the outset, according to the same process as the unitizing process (U), a shock absorbent mat 3, which serves as the shock absorbent member of the present invention, is wrapped around a catalyst substrate 2 as shown in FIG. 2, and fixed by an inflammable tape if necessary. In this respect, it is preferable to a use a conventional wrapping manner by forming in advance an extension and a recess on the opposite ends of the shock absorbent mat 3, respectively, and wrapping the shock absorbent mat 3 around the catalyst substrate 2, with the extension and recess engaged with each other as shown in FIG. 2. As indicated by broken lines in FIG. 2, may be installed a pressure sensing element (SS) and an IC tag (TG) for us in another embodiment which will be described later.

According to the present embodiment, the catalyst substrate 2 is a ceramic columnar member with a honeycomb structure, while it may be made of metal, i.e., its material and method for producing it are not limited herein. The shock absorbent mat 3 is constituted by an alumina mat which will be hardly expanded by heat, in this embodiment, but may be employed a vermiculite mat having a thermal expansion property, or a combination of those mats. Also, may be employed an inorganic fiber mat without binder impregnated. As the pressure is varied depending upon the shock absorbent mat with or without the binder impregnated, and its impregnated amount, it is required to take those into consideration when the pressure is determined. Or, as for the shock absorbent mat, a wire-mesh with thin steal wires meshed, or the like may be used, and it may be combined with a ceramic mat. In addition, those may be used in combination with an annular metallic retainer, a seal ring made of wire mesh, or the like. Furthermore, a shock absorbent mat formed in a cylindrical shape may be used, so that by simply inserting the catalyst substrate 2 into the cylindrical mat, the shock absorbent mat comes to be placed in its mounted state around the catalyst substrate 2.

Figure 3:
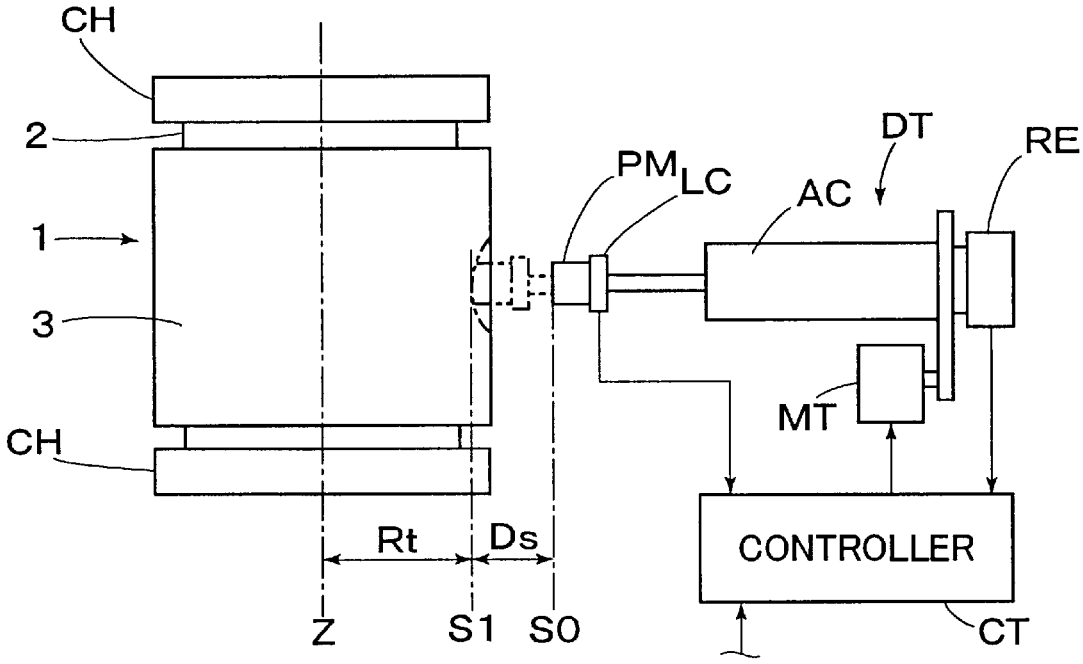
FIG. 3 is a front view showing a measurement process in the method according to an embodiment of the present invention.

Next, referring to FIG. 3, the united product 1 as described above is clamped between a couple of clamp devices (CH), and the catalyst substrate 2 is compressed by the pushing member (PM) of the measuring device (DT) through the shock absorbent mat 3, in a radial direction toward the longitudinal axis of the catalyst substrate 2. Then, the pressure applied to the catalyst substrate 2 is measured, and a distance between the axis (Z) of the catalyst substrate 2 and an end of the pushing member (PM) when the measured pressure (Ps) substantially equals a predetermined target pressure (Pt) is measured, to provide a target radius (Rt). After measuring it, the pushing member (PM) is returned to its initial position, and then the clamping state by the clamp device (CH) is released. The clamp device (CH) and the measuring device (DT) for use in the present embodiment will be explained hereinafter.

In FIG. 3, the clamp device (CH) includes chucks of split dies (fingers) type, which clamp the upper and lower end of the catalyst substrate 2 to place its longitudinal axis (Z) at a predetermined measuring position. The measuring device (DT) of the present embodiment includes an actuator (AC) with a ball screw driven by a motor (MT), the pushing member (PM) mounted on its front end with a load cell (LC) disposed for detecting the pressure, and a rotary encoder (RE) disposed at the rear end of the actuator (AC) for detecting the position. Signals detected by the load cell (LC) and rotary encoder (RE) are input to an electronic control device (hereinafter called as controller CT), and converted into various data as described later to be memorized in a memory (not shown). The motor (MT) is controlled by the controller CT.

The pushing member (PM) is arranged to move back and forth in the direction perpendicular to the axis (Z) of the catalyst substrate 2 (leftward and rightward in FIG. 3), and contact the shock absorbent mat 3 to compress it. As the contacting area of the pushing member (PM) is known, the reaction force caused when the catalyst substrate 2 and shock absorbent mat 3 to be measured are pressed by the pushing member (PM) is detected by the load cell (LC) to provide the pressure applied to the catalyst substrate 2, which is input to the controller (CT). In the controller (CT), the signal detected by the load cell (LC) is converted into the pressure to be memorized into the memory, and compared with the predetermined target pressure (Pt) which was input into the controller (CT) in advance separately. Furthermore, the moving amount and stop position of the pushing member (PM) are detected by the rotary encoder (RE) as factors indicative of rotation of the ball screw (not shown), to be input into the controller (CT). In the controller (CT), the signal detected by the rotary encoder (RE) is converted into the moving amount and stop position of the pushing member (PM) to be memorized in the memory at real time. Those detecting means and the controller (CT) may be connected electrically or optically.

The relationship between a distance from the axis Z of the catalyst substrate 2 to the pushing member (PM), and the pressure applied to the catalyst substrate 2 can be identified, with those measuring device (DT) actuated as follows. That is, when the pushing member (PM) is advanced from its initial position (moved from "S0" point leftward in FIG. 3) to pressurize a part of the shock absorbent mat 3, and the reaction force at the pressurized portion of the shock absorbent mat 3 has reached a predetermined value, a certain position ("S1" point in FIG. 3) is identified. This position ("S1" point in FIG. 3) corresponds to the position of the inner surface of the cylindrical housing 4 which is placed when the pressure of the shock absorbent mat 3 of the finished product has become the target pressure (Pt) (i.e., after the shrinking process). Therefore, the relationship between the pushing force applied to the catalyst substrate 2 and the reaction force (pressure) caused thereby is memorized in advance in the memory of the controller (CT). On the basis of the relationship, the signal detected by the load cell (LC) is converted into the pressure, and with the pressure being compared with a predetermined value, the pushing member PM is advanced to the position ("S1" point in FIG. 3), thereby to detect the moving distance (Ds) of the pushing member PM.

Accordingly, by subtracting the moving distance (Ds) of the pushing member (PM) detected by the rotary encoder (RE), from a predetermined distance between the end position ("S" point in FIG. 3) of the pushing member (PM) and the axis (Z) of the catalyst substrate 2, the initial position of the pushing member (PM), i.e., the position of the target radius (Rt) away from the axis (Z) can be determined. This position corresponds to the position of the inner surface of the cylindrical housing 4 which is placed when the pressure of the shock absorbent mat 3 of the finished product is maintained at a predetermined pressure (i.e., after the shrinking process). According to the present embodiment, therefore, the position ("S1" point in FIG. 3) which becomes the predetermined pressure can be determined, without measuring the dimensions or properties of the catalyst substrate 2 and shock absorbent mat 3 individually, nor using the aforementioned GBD value. That is, as the distance between the end position of the pushing member (PM) and the axis (Z) of the catalyst substrate 2 result in the value taken into consideration not only the error in the outer diameter of the catalyst substrate 2, but also the error in weight per unit area. Therefore, those errors are not required to be measured or evaluated separately, at all.

The distance (Ds) and target radius (Rt) are memorized in the memory of the controller (CT) for the next process, and may be indicated if necessary. A plurality of measuring devices (DT) may be disposed radially about the axis (Z) of the catalyst substrate 2 to achieve the multipoint measurement, or the clamp device (CH) and the united product 1 may be rotated (indexed) about the axis (Z) to achieve the multipoint measurement, and then to obtain the mean value of the measured values. Particularly, in the case where the catalyst substrate 2 is not formed in a circular cross section, it is required to achieve the multipoint measurement dependent upon the shape of the catalyst substrate 2, so that it is desirable to place a plurality of measuring devices (DT). The pushing member (PM) is not necessarily required to be stopped at the predetermined position ("S1" point in FIG. 3), but may be retracted after the position was determined, and further, the clamped state by the clamp device (CH) may be released in synchronously with the retracting motion of the pushing member (PM).

Figure 4:
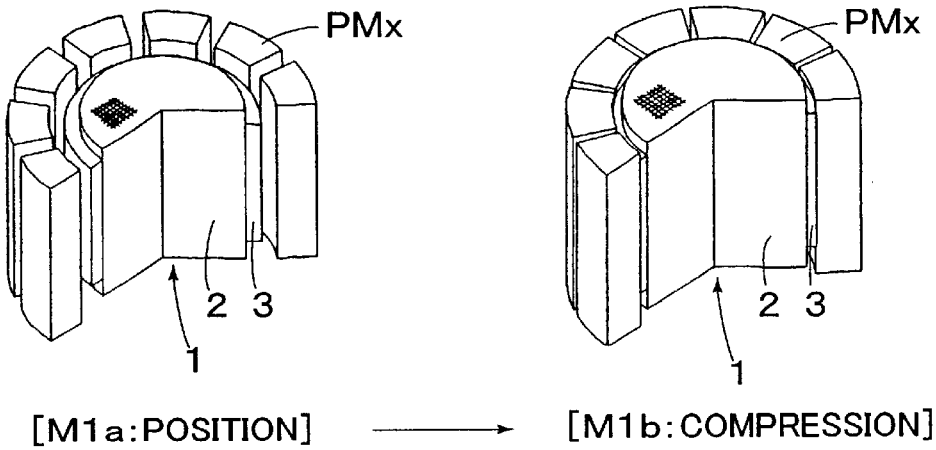
FIG. 4 is a perspective view showing a measurement process in the method according to an embodiment of the present invention.

With respect to the aforementioned measurement process, as shown in FIG. 4, a plurality of pushing members (PMx) may be positioned radially about the axis (Z) of the catalyst substrate 2 (Process M1*a*), and the shock absorbent mat 3 may be compressed by a plurality of measuring devices (DTn) including those pushing members (PMx) to achieve the multipoint measurement (Process M1*b*), or the clamp device (CH) and the united product 1 may be rotated (indexed) about the axis (Z) to achieve the multipoint measurement, and then to obtain the mean value of the measured values. The same is true of the measurement process (M) as shown in FIG. 1. Particularly, in the case where the catalyst substrate 2 is not formed in a circular cross section, it is required to achieve the multipoint measurement dependent upon the shape of the catalyst substrate 2, so that it is desirable to place a plurality of measuring devices (DTn). As shown in FIG. 4, the plurality of pushing members (PMx) comprise elongated members each of which is longer than at least the longitudinal length of the shock absorbent mat 3, and are placed in parallel with one another along the entire periphery of the shock absorbent mat 3, with approximately no clearance between them. The multipoint measurement may be performed by some of them, as will described hereinafter an embodiment capable of performing the multiple measurement, with reference to FIGS. 5 and 6.

Figure 5:
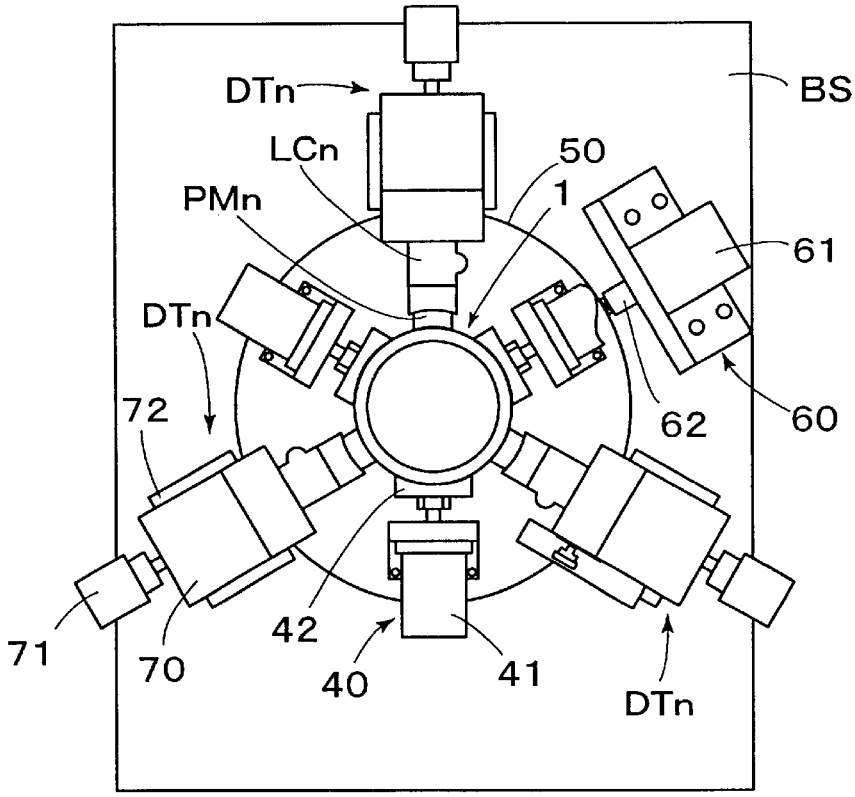
FIG. 5 is a plan view showing an embodiment of a multipoint measuring device for use in the method according to an embodiment of the present invention.
Figure 6:
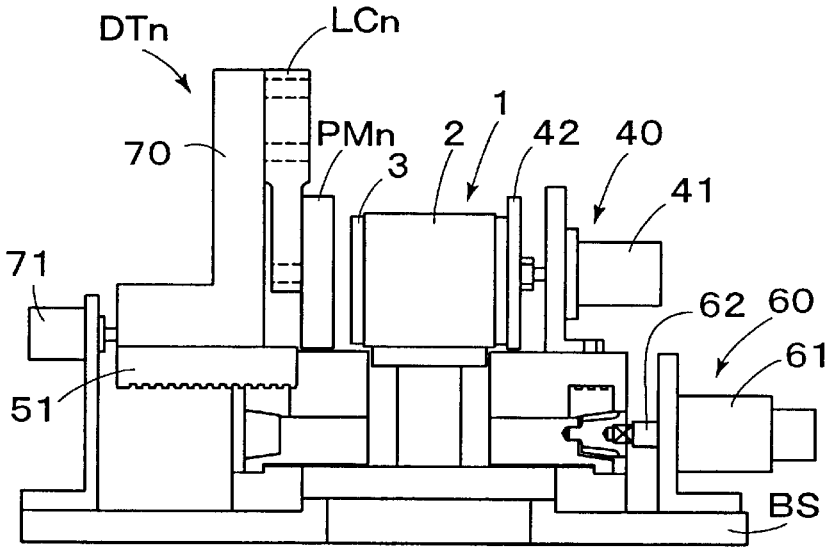
FIG. 6 is a front view showing an embodiment of a multipoint measuring device for use in the method according to an embodiment of the present invention.

FIGS. 5 and 6 illustrate an embodiment of the multipoint measuring device, wherein a so-called scroll chuck 50 and an actuating device 60 for actuating it are placed on a horizontal base (BS). The scroll chuck 50 has three chucks 51 which are placed at three positions evenly spaced around the center, and which are radially movable simultaneously. The chucks 51 are adapted to be moved radially toward or away from the center of them by the same amount respectively, in response to the rotation of a shaft 62, which is rotated by a motor 61 of the actuating device 60. In other words, the three chucks 51 are moved close to or away from each other, or fixed by the actuating device 60. On each chuck 51, L-shaped holder 70 is mounted to serve as each measuring device (DTn), which includes an load cell (LCn) mounted on each L-shaped holder 70, and an elongated pushing member (PMn) fixed to the load cell (LCn). In order to prevent each chuck 51 from being vibrated due to backlash of the scroll chuck 50, each holder 70 is biased toward the center or in the radial direction, by means of an pneumatic cylinder 71 mounted on the base (BS).

In case of measurement, the three chucks 51 and the holder 70 fixed thereto are moved toward the center by the same amount respectively, by means of the actuating device 60, so that each pushing member (PMn) contacts the shock absorbent mat 3 wrapped around the catalyst substrate 2, simultaneously. When each pushing member (PMn) further moves toward the catalyst substrate 2, the shock absorbent mat 3 will be compressed in the radial direction (perpendicularly to the axis of the catalyst substrate 2). The compression reaction force of the shock absorbent mat 3 exerted on each pushed portion thereof is detected by each load cell (LCn), and determined is a position where the detected result has reached a predetermined value, and which position corresponds to the position (S1) away from the center (Z) by the distance (Rt) as shown in FIG. 3. Then, the distance between the each pushing member (PMn) reached that position and the axis of the catalyst substrate 2 is measured, to obtain the mean value. In this respect, as the end of each pushing member (PMn) can be identified on the basis of the number of rotation of the motor 61, for example, the distance between each pushing member (PMn) and the axis of the catalyst substrate 2 can be obtained. Or, as shown in FIG. 5, by means of a position measuring device 72 using a digital length measuring system, e.g., "magnescale" of Sony Precision Technology Inc., the moving amount of the holder 70 or the like can be measured directly. According to the present embodiment, therefore, the moving distance of each pushing member (PMn) is measured directly by the position measuring device 72.

Furthermore, three holing devices 40 are mounted on the scroll chuck 50 to be evenly spaced between each pushing member (PMn). The holing devices 40 are provided with pneumatic cylinders 41 biasing holding members 42 in the radial direction toward or away from the center, for positioning (centering) the united product 1 of the catalyst substrate 2 and shock absorbent mat 3, and assisting to hold it during the measurement process. Accordingly, in advance of the measurement process, each holing devices 40 is moved toward the center to position the united product 1, and hold it, with a little force applied toward the center. In this holding state, a consecutive measurement process by the measuring device (DTn) is achieved. After the measurement is finished, the holding member 42 is actuated by the pneumatic cylinder 41 in the radial direction away from the shock absorbent mat 3 to return to its initial position.

After the measurement was achieved in the measurement process (M), the sizing process is performed on the basis of the measurement result in the sizing process (V). The relationship between these processes will be explained hereinafter, with reference to FIG. 7. The measurement process (M) of this embodiment is basically the same as the measurement process shown in FIG. 3, as shown at the left side in FIG. 7, which shows a part of the multipoint measuring device with a plurality of pushing members (PMx) disposed around the axis (Z) of the catalyst substrate 2 as shown in FIG. 4. According to this method, the pushing member (PMx) is advanced from its initial position (from "S0" point rightward in FIG. 7) to pressurize the shock absorbent mat 3, with the pressurizing force (Fp) applied thereto, along the entire longitudinal length of the shock absorbent mat 3. Then, by detecting a certain position ("S1" point in FIG. 7) when the pressure at the pressurized portion (the reaction force of the shock absorbent mat 3) obtained on the basis of the detected value of the load cell (LCx) has reached the target pressure (Pt), the position with the target radius (Rt) away from the axis (Z) of the catalyst substrate 2 can be determined.

In the sizing process (V), therefore, if the diameter of the cylindrical housing 4 is reduced, with the shock absorbent mat 3 being compressed, to such an extent that the inner radius of the part of the cylindrical housing 4 for enclosing the shock absorbent mat 3 substantially equals the target radius (Rt), the catalyst substrate 2 is held in the cylindrical housing 4 to be compressed at the target pressure (Pt). In this case, the diameter of the cylindrical housing 4 is reduced, with the shock absorbent mat 3 being compressed, by means of a plurality of compressing members (DVx), instead of which the pushing members (PMx) for the measurement process may be used also for the sizing process, as follows. Based upon the moving distance (Ds) from the initial position ("S0" point) of the pushing members (PMx) in the measurement process, if the compressing members (DVx) are moved by the distance (Ds−t) which is the result of subtracting the thickness (t) of the cylindrical housing 4 from the moving distance (Ds), the inner radius of the part of the cylindrical housing 4 will become substantially equal to the target radius (Rt).

According to the shrinking process in the sizing process (V) as described above, the change in diameter (spring back) and the change in wall thickness of the cylindrical housing 4 evaluated by the correction setting process (V3) in FIG. 1 have not been taken into consideration. Considering the amount of correction (ds, dt), the target distance (Dt) can be calculated by the equation of Dt=Ds+ds−(t+dt), when moving the compressing members (DVx). Therefore, if the compressing members (DVx) is moved from its initial position ("S0" point) by the target distance (Dt) to reduce the diameter of the cylindrical housing 4 together with the shock absorbent mat 3, the catalyst substrate 2 will be held in the cylindrical housing 4, with the pressure applied to the catalyst substrate 2 adjusted to be the target pressure (Pt). Hereinafter, will be explained by the target pressure (Pt), while it may be so constituted that the position being away from the axis (Z) by the target radius (Rt) is identified, and the movement of the compressing members (DVx) is adjusted with the amount of correction (ds, dt).

Figure 29:
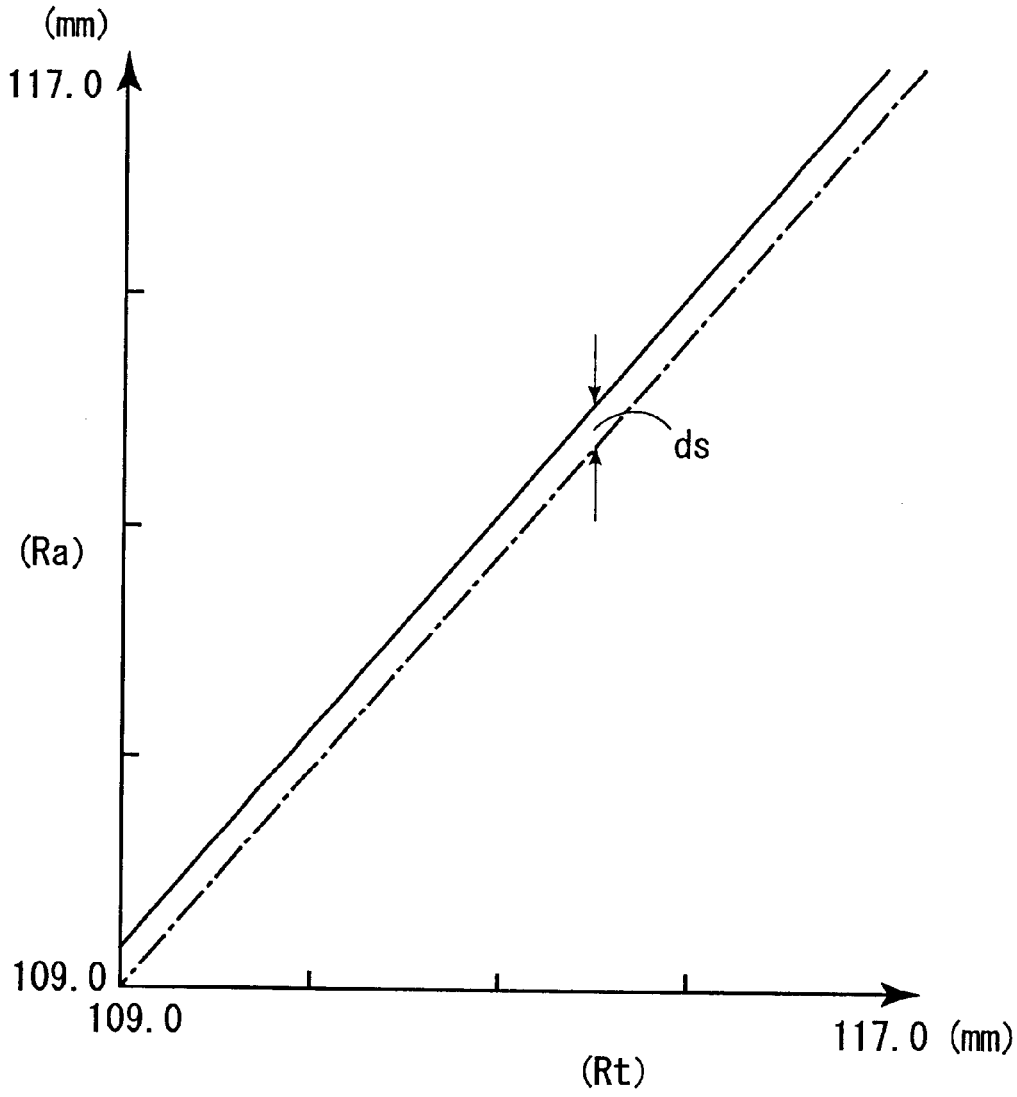
FIG. 29 is a diagram showing an example of a result of an experiment for obtaining a change in diameter of a cylindrical housing caused by a spring back, from a relationship between the target radius and actual radius of the cylindrical housing when its diameter is reduced, in the method according to an embodiment of the present invention.

The change in diameter of the cylindrical housing 4 caused by its spring back can be determined as the amount of correction (ds) in advance, on the basis of the result measured before the shrinking process. As shown in FIG. 29, an experiment has result in indicating the relationship between the target radius (Rt) and the actual radius (Ra) of the cylindrical housing 4 when its diameter is reduced. In FIG. 29, the result without the spring back is indicated by a one-dot chain line, and the result with the spring back is indicated by a solid line. According to an example of the cylindrical housing 4 as shown in FIG. 29, the change in diameter of the cylindrical housing 4 caused by its spring back was substantially constant to provide approximately 0.35 mm as the change, i.e., ds=0.35. Likewise, the change in diameter of the cylindrical housing 4 caused by the change in its wall thickness was substantially constant to provide approximately 1.05, i.e., increase of approximately 5%.

Figure 7:
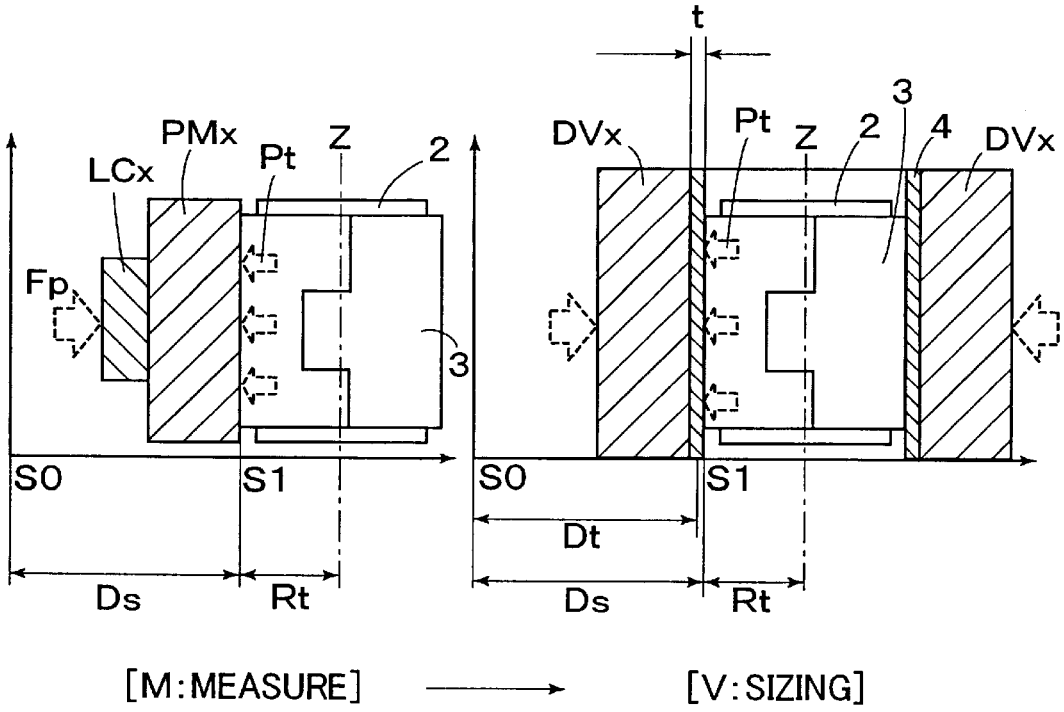
FIG. 7 is a diagram for explaining a measurement process and a sizing process in the method according to an embodiment of the present invention.
Figure 8:
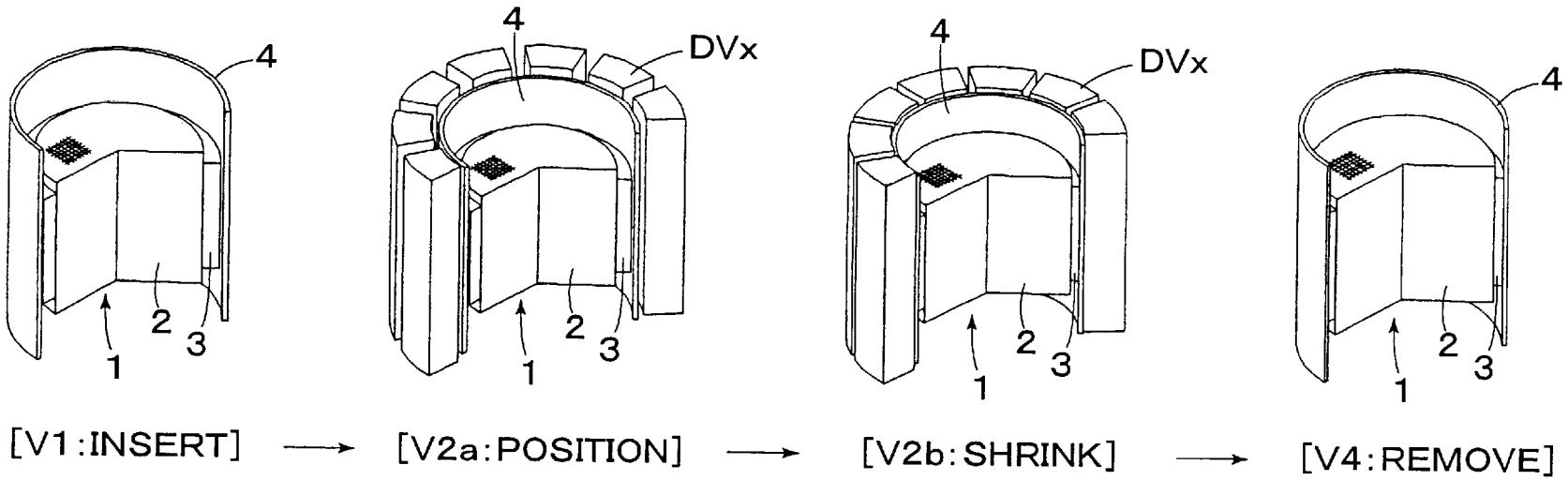
FIG. 8 is a perspective view showing a sizing process in the method according to an embodiment of the present invention.

FIG. 8 illustrates a practical embodiment of the sizing process (V) in FIG. 7, as well as the sizing process (V) in FIG. 1. At the outset, the united product 1 with the shock absorbent mat 3 wrapped around the catalyst substrate 2 is inserted into the cylindrical housing 4 loosely (Process V1 in FIG. 8). Next, the united product 1 and the cylindrical housing 4 are inserted into a cylinder formed by a plurality of compressing members (DVx) to be placed at a predetermined position (Process V2*a* in FIG. 8). Then, the diameter of the cylindrical housing 4 is reduced together with the shock absorbent mat 3 by the compressing members (DVx) (Shrinking), to such an extent that the inner radius of the part of the cylindrical housing 4 substantially equals the target radius (Rt) (Process V2*b* in FIG. 8). As a result, when the united product 1 and the cylindrical housing 4 are removed from the compressing members (DVx) (Process V4 in FIG. 8), there is produced an intermediate product which holds the united product 1 with the shock absorbent mat 3 wrapped around the catalyst substrate 2 to be compressed at the target pressure (Pt) in the cylindrical housing 4. Then, at least an end portion of the intermediate product will be formed by the necking process (N) as shown in FIG. 1 to be a finished product, as will be described later.

Figure 9:
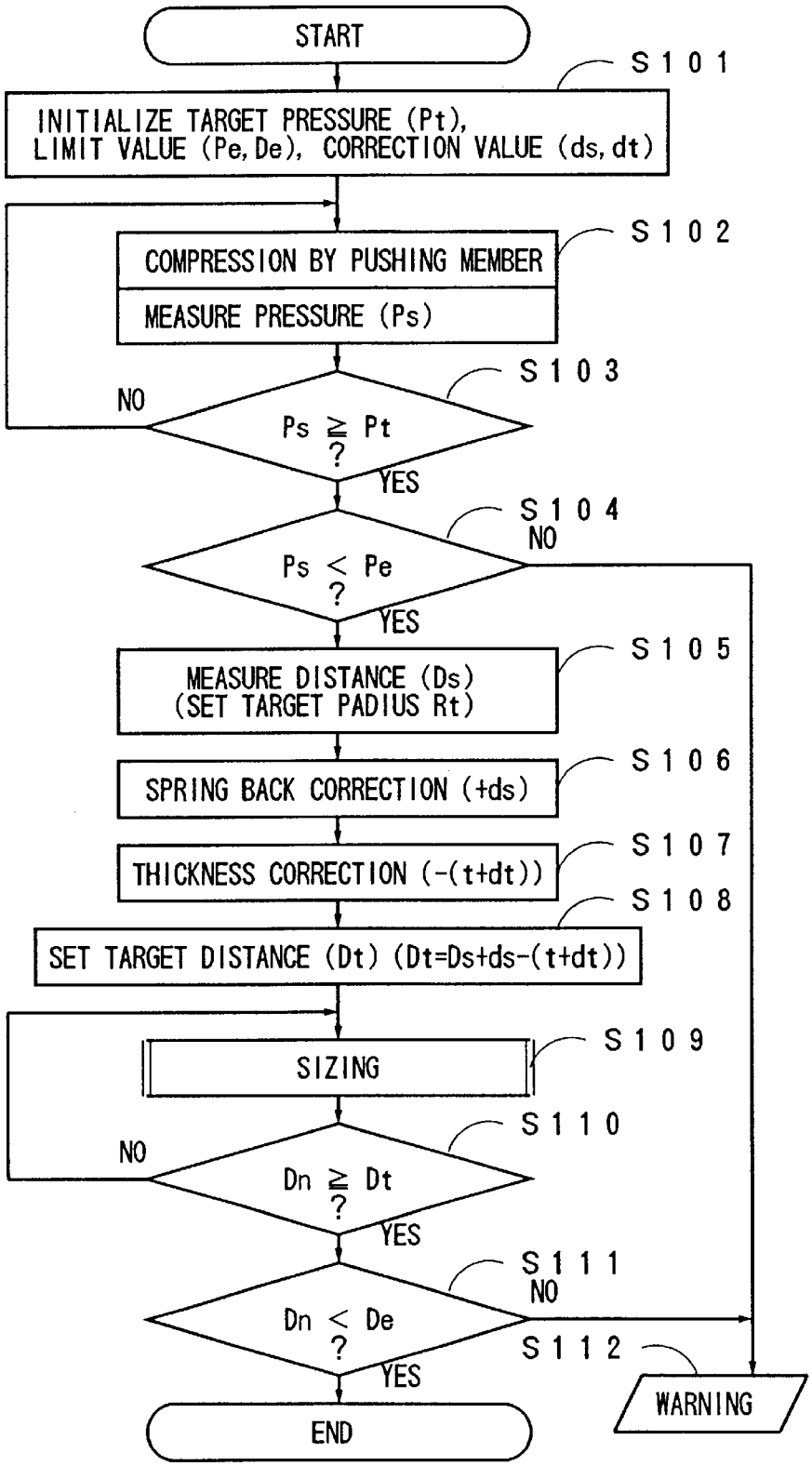
FIG. 9 is a flowchart showing an example of the measurement process and sizing process in the method according to an embodiment of the present invention.

FIG. 9 is a flowchart showing the process of producing the catalytic converter, according to the measurement process (M) as shown in FIG. 4 and the sizing process (V) as shown in FIG. 8, and based upon the relationship between those processes as shown in FIG. 7. At Step S101, initial values are set for the target pressure (Pt), correction amounts (ds, dt), and limits (Pe, De) of the pressure and moving distance as described later. The correction amounts (ds, dt) are set on the basis of the result measured in advance with respect to the cylindrical housing 4 to be sized, whereas the limits (Pe, De) are set in advance on the basis of the property of the shock absorbent mat 3. Then, at Step S102, the pushing member (PMx) is moved to compress the shock absorbent mat 3, and the pressure (Ps) applied to the catalyst substrate 2 is detected according to the measurement process as described before. The pushing member (PMx) will be moved, until the pressure (Ps) equals the target pressure (Pt). As a result, if the pressure (Ps) is equal to or greater than the target pressure (Pt), the process proceeds to Step S104, where it is determined whether the pressure (Ps) is less than the limit (Pe). If it is less than the limit (Pe), the process further proceeds to Step S105, whereas if it is equal to or greater than the limit (Pe), the process jumps to Step S112 where a warning signal is output.

At Step S105, the moving distance (Ds) of the pushing member (PMx) is detected to provide it as the target radius (Rt). Then, at Steps S106 and S107, the amount of correction (ds) is added to the moving distance (Ds), to correct the latter in response to the change in diameter due to the spring back, and the amount of correction (dt) is added to the wall thickness (t), to correct the latter in response to the change in wall thickness due to the increase of its wall thickness. The corrected result [Ds+ds−(t+dt)] is set as the target distance (Dt) at Step S108. Based on this target distance (Dt), the sizing process is achieved at Step S109 as described with reference to FIG. 8, the compressing members (DVx) are moved until the moving distance (Dn) becomes equal to or greater than the target distance (Dt). As a result, if it is determined at Step S110 that the moving distance (Dn) is equal to or greater than the target distance (Dt), the process proceeds to Step S111, where it is determined whether the moving distance (Dn) is less than the limit (De). If the moving distance (Dn) is less than the limit (De), the process will end, whereas if it is equal to or greater than the limit (De), the process proceeds to Step S112 where the warning signal is output.

Figure 10:
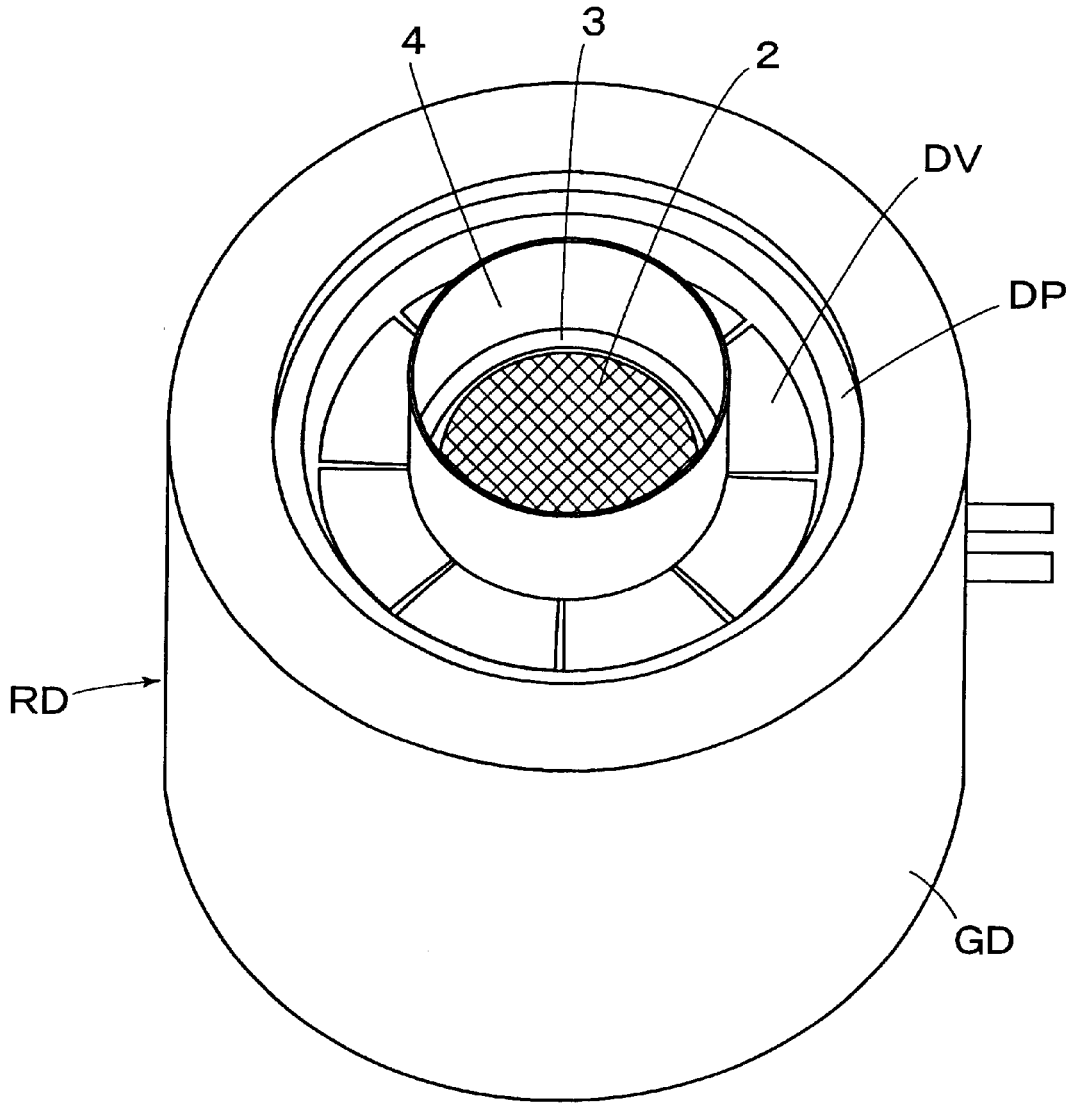
FIG. 10 is a perspective view showing a first embodiment of a shrinking device for use in a method for producing an exhaust gas purifying device according to an embodiment of the present invention.
Figure 12:
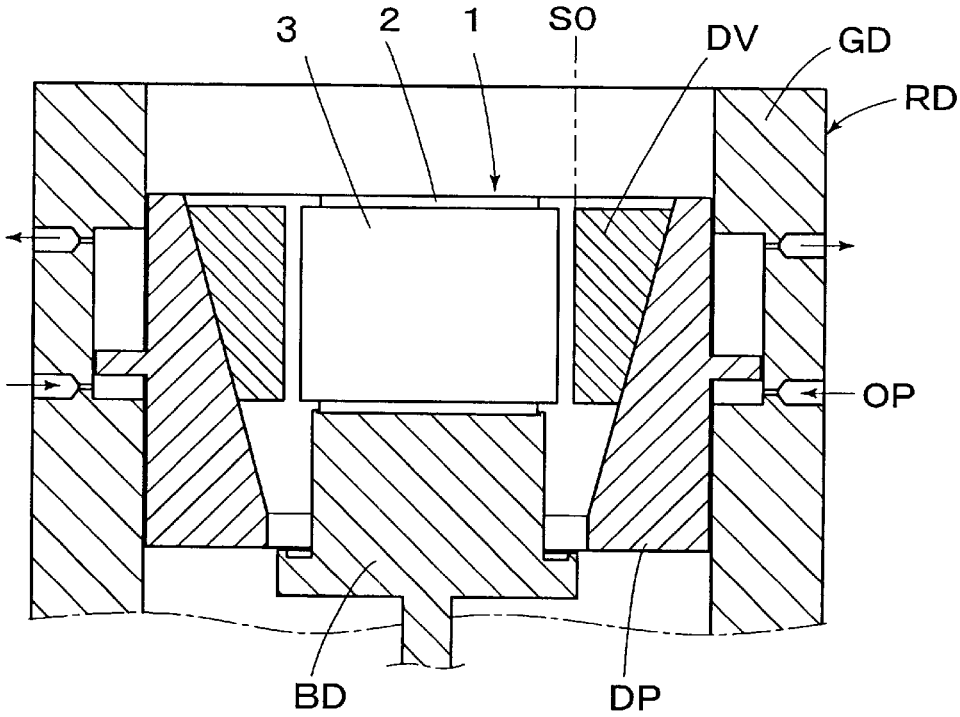
FIG. 12 is a sectional view showing a part of a shrinking device for use in the method according to an embodiment of the present invention.

FIG. 10 illustrates an embodiment of the shrinking device (RD) for use in the sizing process (V) as disclosed in FIG. 8, using the chucks of split dies type (finger type). As shown in FIG. 10, a cylindrical pushing die (DP) having a tapered inner surface is accommodated fluid-tightly and slidably in a cylindrical housing (GD). Furthermore, a plurality of split dies (DV) are accommodated in the cylindrical pushing die (DP), to function at least as the compressing members (DVx) in FIG. 8 for use in the shrinking process. As shown in FIG. 12, each split die (DV) has a tapered outer surface, to be slidably fitted into the inside of the pushing die (DP). Furthermore, a receiving bed (BD) for placing thereon the united product 1 is disposed on the central axis of the housing (GD), as shown in FIG. 12. The pushing die (DP) and split dies (DV) are actuatyed by a hydraulic pressure actuating device (not shown), so that the pushing die (DP) is moved along the axis (longitudinal direction) of the housing (GD) by the hydraulic pressure (indicated by "OP" in FIG. 12), and the split dies (DV) are moved radially (toward the central axis) in response to movement of the pushing die (DP) (upward in FIG. 12). The hydraulic pressure actuating device (not shown) is controlled by a controller (not shown) as will be described later.

Figure 11:
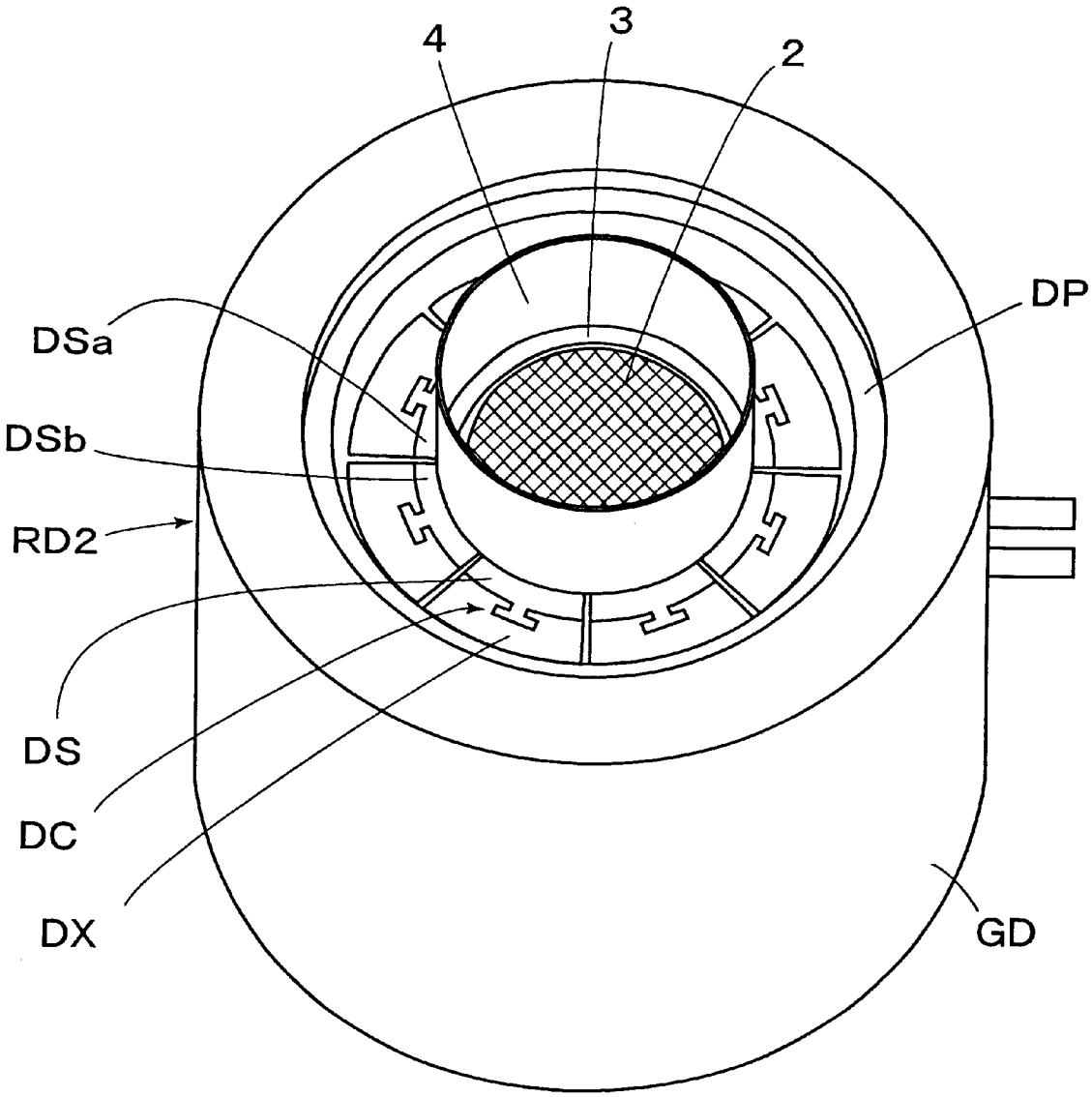
FIG. 11 is a perspective view showing a second embodiment of a shrinking device for use in a method for producing an exhaust gas purifying device according to an embodiment of the present invention.

Alternatively, if a shrinking device (RD2) as shown in FIG. 11 is used instead of the shrinking device (RD), the aforementioned shrinking process can be achieved more appropriately. The shrinking device (RD2) has the split dies (DV), each of which is divided into two segments of a segment (DS) and a back metal (DX). The neighboring segment (DS) and back metal (DX) are connected by means of a T-slot (DC), respectively, so that the segment (DS) is removable. As a result, the segment (DS) can be selected in accordance with the diameter of the cylindrical hosing to be formed. On both edge corners of the segment (DS), there are formed shoulders DSa and DSb having smooth round surface, which are preferably to be formed with the radius of several millimeters. Consequently, when the diameter of the housing is reduced to its minimum in the measurement process to minimize the clearance between the neighboring segments (DS), a part of the shock absorbent mat 3 can be prevented from being caught in the clearance. On the segment (DS), or between the segment (DS) and back metal (DX), a pressure sensor (corresponding to the sensor as indicated by "SS" in FIG. 2) may be disposed.

Figure 14:
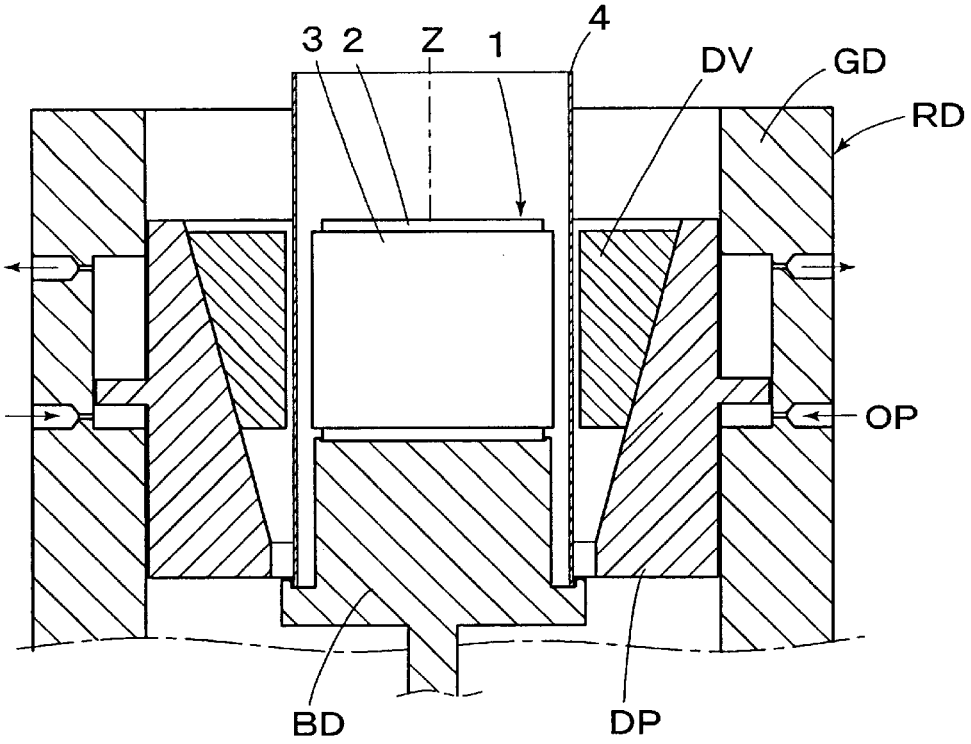
FIG. 14 is a sectional view showing a state of beginning a shrinking process by means of a shrinking device for use in the method according to an embodiment of the present invention.

Next will be explained the shrinking process for reducing the diameter of the body portion of the cylindrical housing 4 together with the shock absorbent mat 3, by the shrinking device (RD) as shown in FIG. 10, which is employed herein for easily explaining the process, while the shrinking device (RD2) as shown in FIG. 11 may be used. In either shrinking device, eight dies have been provided, but the number of dies is not limited to it. It may be larger or smaller than eight, and may be of odd or even number. Any method for moving the dies may be used. Although it is desirable to control as many dies as possible individually, the number of dies may be determined in view of the required accuracy, feasibility, cost or the like. A collet type may be employed. According to the shrinking device (RD) as shown in FIG. 10, therefore, after the united product 1 was placed on the receiving bed (BD) as shown in FIG. 12, the cylindrical housing 4 is placed on an annular step portion formed at the bottom of the bed (BD), as shown in FIG. 14, so that the axis of the cylindrical housing 4 substantially lies on the axis (Z) of the catalyst substrate 2. As a result, the united product 1 is loosely received in the cylindrical housing 4.

The cylindrical housing 4 of the present embodiment is made of a stainless steel tube, for example, and called as an outer tube, housing or casing for the finished product. The inner diameter of the cylindrical housing 4 is larger than the outer diameter of the shock absorbent mat 3 wrapped around the catalyst substrate 2. Therefore, the catalyst substrate 2 and the shock absorbent mat 3 wrapped around it are smoothly received in the cylindrical housing 4, so that the outer surface of the shock absorbent mat 3 is not pressed onto the inner surface of the cylindrical housing 4, i.e., the former is not stuffed (or pressed) into the latter. Therefore, the catalyst substrate 2 and the shock absorbent mat 3 are smoothly accommodated in the cylindrical housing 4, so that they will not be fractured. As for the cylindrical housing 4, it is not limited to the stainless steel tube, but it may be a tube made of other metals. Furthermore, a sheet metal may be formed into a tube in a previous process, or a pipe on the market may be cut to provide the cylindrical housing 4. Although its wall thickness is not limited, that of 1–3 millimeters is preferable for the catalytic converter.

Figure 15:
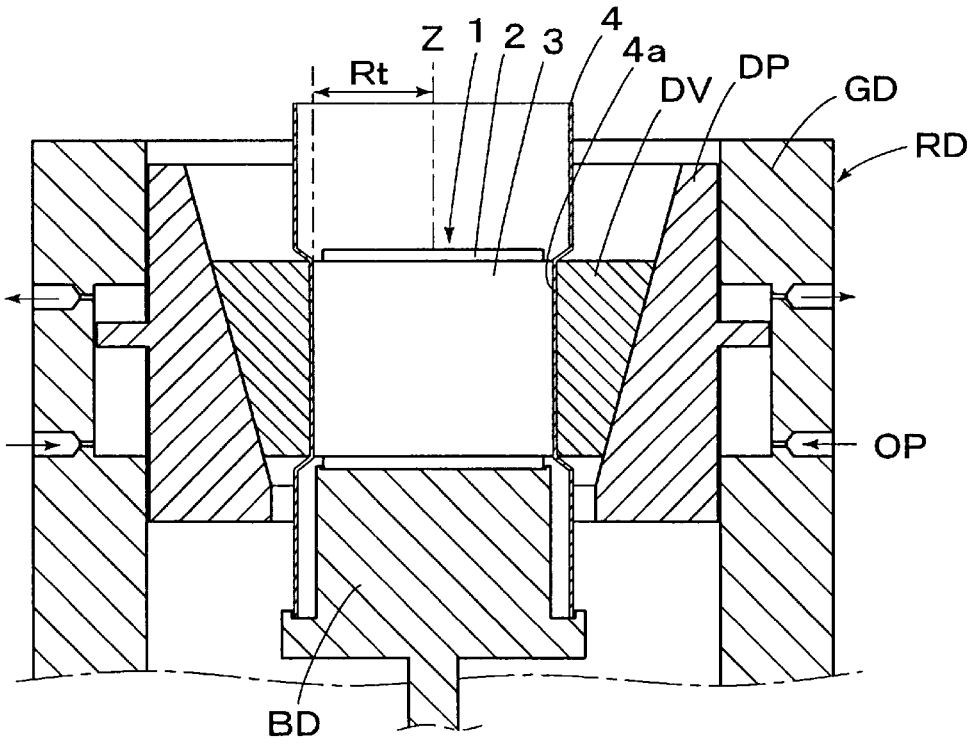
FIG. 15 is a sectional view showing a state of finishing a shrinking process by means of a shrinking device for use in the method according to an embodiment of the present invention.

Referring to FIG. 14, when the hydraulic pressure actuating device (not shown) is actuated by the hydraulic pressure (indicated by "OP" in FIG. 14) to move the pushing die (DP) along the axis of the housing (GD), i.e., move upward in FIG. 14, the split dies (DV) are moved radially (toward the central axis) as shown in FIG. 15, whereby the body portion of the cylindrical housing 4 and the shock absorbent mat 3 are compressed to reduce the diameters. The reduced amount in this case is controlled accurately by the controller (not shown) for actuating the hydraulic pressure actuating device, so that the cylindrical housing 4 and the shock absorbent mat 3 are compressed and centralized, until the distance between the axis (Z) of the catalyst substrate 2 and the inner surface of the cylindrical housing 4 will become the target radius (Rt), to form the reduced diameter portion 4*a* as shown in FIG. 15. In other words, according to the sizing process performed at Step S109, the corrected target distance (Dt) is used, so that the distance between the axis (Z) of the catalyst substrate 2 and the inner surface of the cylindrical housing 4 will become the target radius (Rt).

For example, it is preferable to measure in advance a limit radius (Re) of the cylindrical housing 4, which is provided when the shock absorbent mat 3 is compressed by the pushing member (PMx) to such an extent that the inner radius of at least the part of the cylindrical housing 4 for covering the shock absorbent mat 3 is reduced to be less than the target radius (Rt) and immediately before the catalyst substrate 2 will be fractured. Then, by setting a predetermined distance less than the difference between the limit radius (Re) and the target radius (Rt) as the amount of correction (ds), and correcting the moving distance (Ds) on the basis of the amount of correction (ds) to set the target moving distance (Dt), and using the target moving distance (Dt) for the NC control of the shrinking device (RD) to shrink the cylindrical housing 4 together with the shock absorbent mat 3, the substantial radius of the cylindrical housing 4 when the spring back was caused after the shrinking process will equal the target radius (Rt). Therefore, the distance between the axis (Z) of the catalyst substrate 2 and the inner surface of the cylindrical housing 4 will become the target radius (Rt), without being affected by the spring back. Consequently, the catalyst substrate 2 can be held in the cylindrical housing 4 appropriately, without fracturing the catalyst substrate 2, even if it is especially fragile.

As described above, the hydraulic pressure actuating device (not shown) for actuating the shrinking device (RD) is controlled by the controller (not shown), and the sizing process by any amount of reduction can be achieved according to NC control, to enable a fine control. Furthermore, in the shrinking process, a workpiece may be rotated occasionally to perform the index control, the cylindrical housing 4 can be reduced in diameter more uniformly about its entire periphery. The control medium for the shrinking device (RD) is not limited to the hydraulic pressure. With respect to the actuating and controlling system, any actuating system including a mechanical system, electric system, pneumatic system or the like may be employed, and preferably a CNC control system may be used.

According to the present embodiment, therefore, the body portion of the cylindrical housing 4 can be reduced in diameter with such a good accuracy that the pressure applied to the catalyst substrate 2 will not exceed the target pressure, without being affected by the scale of the catalyst substrate 2 or cylindrical housing 4, and the property of the shock absorbent mat 3, in other words, without being affected by the error in outer diameter of the catalyst substrate 2, error in inner diameter of the cylindrical housing 4, weight per unit area of the shock absorbent mat 3 and so on, and with adjustment made in advance on the basis of the change in diameter due to the spring back and the change in wall thickness. Particularly, as the amount of correction can be determined in advance, the variable measured value will be only the distance between the axis (Z) of the catalyst substrate 2 and the end of the pushing member (PM) at last, to provide certainly an appropriate value. Accordingly, the catalyst substrate 2 can be held in the cylindrical housing 4 (through the shock absorbent mat 3) always at a stable accuracy.

Figure 28:
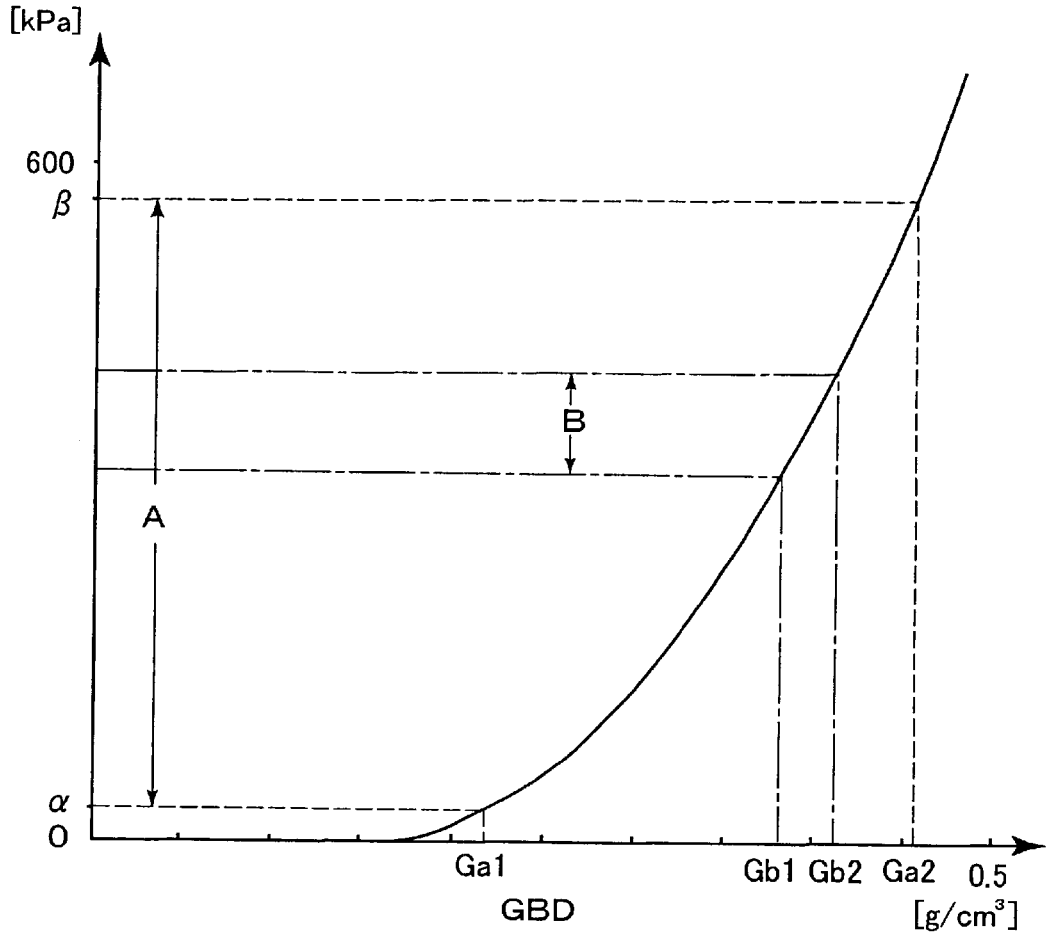
FIG. 28 is a diagram showing a pressure allowable range for an example of a shock absorbent member in a conventional catalytic converter.

As a result, in contrast to the pressure allowance range ($\beta-\alpha$) in the prior art, which was the range as indicated by "A" in FIG. 28 (GBD applicable in this case was the range of Ga1–Ga2), the pressure allowance range in the present embodiment as described above becomes the range as indicated by "B", which corresponds to the range as small as Gb1–Gb2. In other words, with respect to the ceramic catalyst substrate 2 having the thin walls which are weak especially in the radial direction, the pressure allowance range ($\beta-\alpha$) will be caused to be small and the applicable GBD will become the range of Gb1–Gb2. According to the present embodiment, however, the sizing process can be achieved for that catalyst substrate 2 appropriately, without fracturing it.

In the case where the shock absorbent mat 3 has such a property that it will take a predetermined time (e.g., a few minutes) to be restored from a compressed (reduced in diameter) state of the mat 3 to its state before compressed, can be easily inserted into the cylindrical housing 4, the catalyst substrate 2 wrapped with the shock absorbent mat 3 in such a state that the shock absorbent mat 3 is being restored from its compressed state (the state with the target pressure provided) to its state before compressed, after it was measured as shown in FIG. 3. Therefore, in the case where the inner diameter of the cylindrical housing 4 is set on the basis of the state that it is being restored from the compressed state of the mat 3 to its state before compressed, then the shock absorbent mat 3 can be inserted smoothly into the cylindrical housing 4, even if the initial inner diameter of the cylindrical housing 4 is set to be smaller than that set in the process as described before, whereby the reducing amount of the cylindrical housing 4 can be minimized.

Next will be explained such an embodiment that the plurality of split dies (DV) are constituted to function as the pushing member for the measurement (e.g., the pushing member (PMx) in FIG. 4), and shrink the cylindrical housing 4 together with the shock absorbent mat 3 toward the axis (Z) of the catalyst substrate 2, to achieve the processes from the measurement process to the shrinking process as a consecutive processes, by a single device, with reference to FIGS. 12–15. That is, the shrinking device (RD) of the present embodiment is adapted to function as the measuring device (DT) as described before, so that the measurement process and sizing process can be performed consecutively by the single device, according to the flowchart as shown in FIG. 9, for example. In this case, are required a pressure sensor (not shown) for sensing the pressure (OP) and an encoder (not shown) for detecting a stroke of the dies (DV) to measure its moving distance. The former is adapted to detect the reaction force of the shock absorbent mat 3 through the reaction force of the hydraulic pressure, and may be constituted by the pressure sensor such as the load cell mounted on the pressing surface of the split dies (DV), functioning as the pushing member (PMx). The latter (the encoder) may be adapted to detect the stroke of the pushing die (DP), or detect the hydraulic amount discharged from the pump as the applied pressure, to detect the stroke. Furthermore, the device may be provided with biasing means for assisting the split dies (DV) to return to its initial position.

Figure 13:
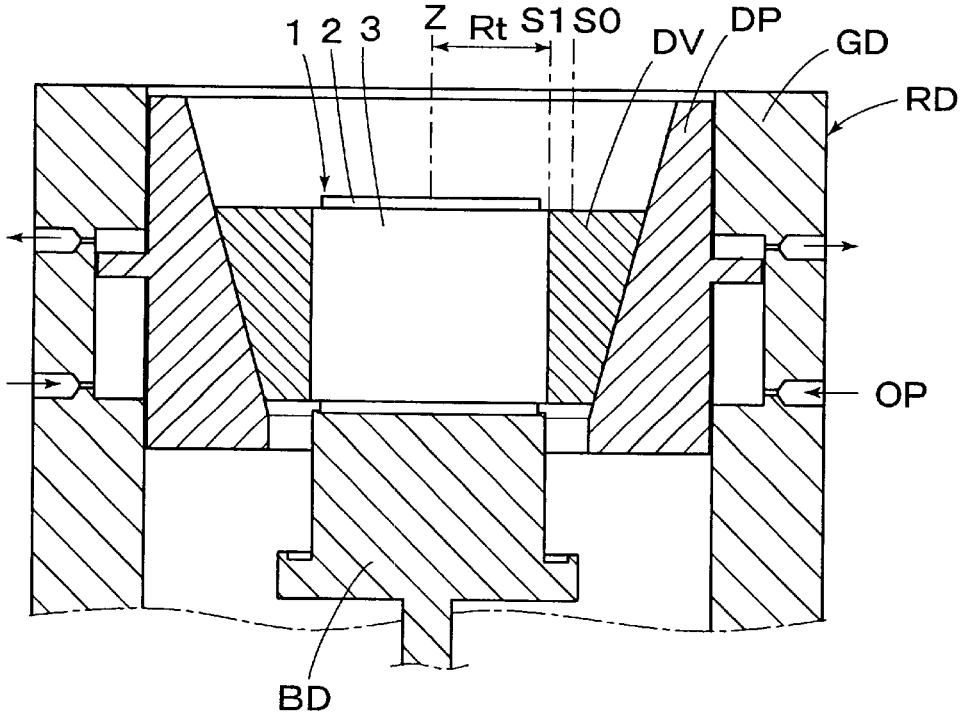
FIG. 13 is a sectional view showing a measuring state by means of a shrinking device for use in the method according to another embodiment of the present invention.

At the outset, the united product 1 is placed on the receiving bed (BD) as shown in FIG. 12. Next, the hydraulic pressure actuating device (not shown) is actuated to move the pushing die (DP) along the axis of the housing (GD) (upward in FIG. 13) by the hydraulic pressure (OP in FIG. 13), the split dies (DV) are moved radially (toward the axis) as shown in FIG. 13 to compress the shock absorbent mat 3. In this case, the split dies (DV) function as the pushing member (PMx) as shown in FIG. 4. Thus, the split dies (DV) are moved from their initial positions ("S0" point in FIG. 12)

toward the axis (Z), to pressurize the shock absorbent mat 3, and when the reaction force of the shock absorbent mat 3 has reached a predetermined value, a certain position ("S1" point in FIG. 13) is detected. The position ("S1" point in FIG. 13) corresponds to the position of the inner surface of the cylindrical housing 4 which is placed when the pressure of the shock absorbent mat 3 of the finished product has become the target pressure (Pt) (i.e., after the shrinking process). According to the present embodiment, therefore, the signal detected by the pressure sensor (not shown) is converted into the pressure value, and with the pressure being compared with a predetermined value, the split dies (DV) are moved to the position as described above ("S1" point in FIG. 13), thereby to detect the moving distance of the split dies (DV).

Accordingly, by subtracting the moving distance of the split dies (DV) detected by the encoder (not shown), from a predetermined distance between the initial position ("S0" point in FIG. 12) of the split dies (DV) and the axis (Z) of the catalyst substrate 2, the initial position of the split dies (DV), i.e., the position of the target radius (Rt) away from the axis (Z) can be determined. Therefore, if the aforementioned spring back and the change in wall thickness are ignored, that position corresponds to the position of the inner surface of the cylindrical housing 4 (after the shrinking process), in which the pressure applied to the shock absorbent mat 3 is maintained at a predetermined value. Therefore, if the process considering the amount of correction (ds, dt) in view of the spring back and the change in wall thickness as shown in FIG. 9 is further applied, the target radius (Rt) can be ensured after the shrinking process.

Then, after the split dies (DV) were retracted, the cylindrical housing 4 is positioned as shown in FIG. 14. When the hydraulic pressure actuating device (not shown) is actuated by the hydraulic pressure ("OP" in FIG. 14) to move the pushing die (DP) along the axis of the housing (GD), i.e. move upward in FIG. 14, the split dies (DV) are moved radially (toward the central axis) as shown in FIG. 15, whereby the body portion of the cylindrical housing 4 and the shock absorbent mat 3 are compressed to reduce the diameters. The split dies (DV) function as the pushing member (DVx), and the moving amounts are controlled accurately by the controller (not shown), so that the cylindrical housing 4 and the shock absorbent mat 3 are shrinked, until the distance between the axis (Z) of the catalyst substrate 2 and the inner surface of the cylindrical housing 4 will become the target radius (Rt), to form the reduced diameter portion 4*a* as shown in FIG. 15.

According to the present embodiment, after the body portion of the cylindrical housing 4 with the catalyst substrate 2 and the shock absorbent mat 3 accommodated therein was reduced in diameter, the necking process is applied to the opposite ends of the cylindrical housing 4 by a spinning process as explained hereinafter. At the outset, the body portion (reduced diameter portion 4*a*) is clamped by a clamp device (CL) for a spinning apparatus (not shown), not to be rotated, and not to be moved axially. Then, the spinning process is applied to an end portion of the cylindrical housing 4, by means of a plurality of spinning rollers (SP), which are revolved about the axis of the end portion of the cylindrical housing 4 along a common circular locus. That is, the spinning rollers (SP), which are positioned around the outer periphery of the end portion of the cylindrical housing 4, preferably with an equal distance spaced between the neighboring rollers, are pressed onto the outer surface of the end portion of the cylindrical housing 4, and revolved about the axis thereof, and moved along the axis (to the right in FIG. 16), with a revolutionary locus reduced, to achieve the spinning process. Accordingly, one end portion of the cylindrical housing 4 is reduced in diameter by the spinning rollers (SP) to provide a tapered portion 4*b* and a bottle neck portion 4*c* without any stepped portions formed between them, to form a smooth surface. Before the necking process, a stepped portion 4*d* has been formed after the cylindrical housing 4 was shrinked, as shown at the left side in FIG. 16.

Figure 16:
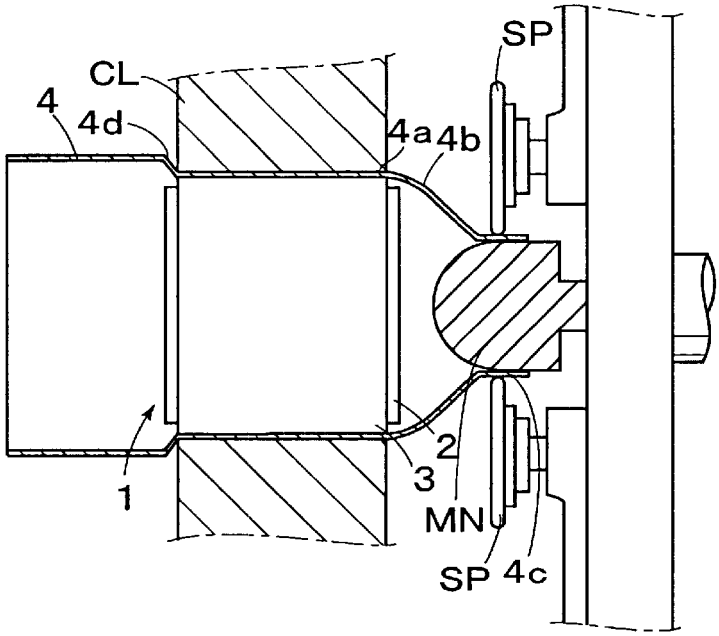
FIG. 16 is a sectional view showing a spinning process to an end portion in the method according to an embodiment of the present invention.
Figure 17:
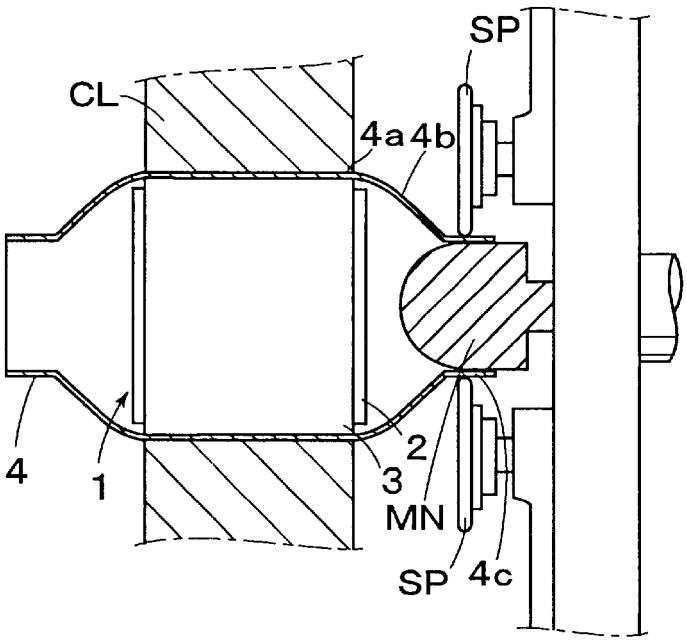
FIG. 17 is a sectional view showing a spinning process to an end portion in the method according to another embodiment of the present invention.

Next, the cylindrical housing 4 is reversed by 180 degree, and positioned as shown in FIG. 17, so that the necking process is performed by means of the spinning rollers (SP), with respect to the other one end portion of the cylindrical housing 4, as well. The reversing operation of the cylindrical housing 4 is performed after the process as shown in FIG. 16. That is, the cylindrical housing 4 is released from the clamp device (CL), and reversed by a robot hand (not shown), and then clamped again by the clamp device (CL). The robot may be used for supplying workpieces such as the cylindrical housing 4 and transferring the same, to obtain a more efficient productivity. Or, the clamp device (CL) itself may be reversed. Thereafter, the body portion of the cylindrical housing 4 is clamped again by the clamp device (CL), and the other one end portion (left portion in FIG. 16) of the cylindrical housing 4 is formed by the spinning rollers (SP) to form the tapered portion 4*b* and the bottle neck portion 4*c* as shown in FIG. 17. Preferably, the clamp device (CL) may be of the type adjustable for variable diameters with aligning function, e.g., chucks of split dies type (finger type). Furthermore, the clamp device having the indexing function is effective in the case where the opposite neck portions are not formed on the same surface in the offset/oblique necking processes as described later.

As shown in FIGS. 16 and 17, when the necking process is performed by the spinning rollers (SP), with the axially movable mandrel (MN) inserted into the open end of the cylindrical housing 4, accuracy of shape of the bottle neck portion 4*c* can be improved. Instead, after the necking process was applied to one end portion of the cylindrical housing 4 at first, the reduced diameter portion 4*a* is formed as shown in FIG. 15, and finally the necking process may be applied to the other one end portion of the cylindrical housing 4.

Figure 18:
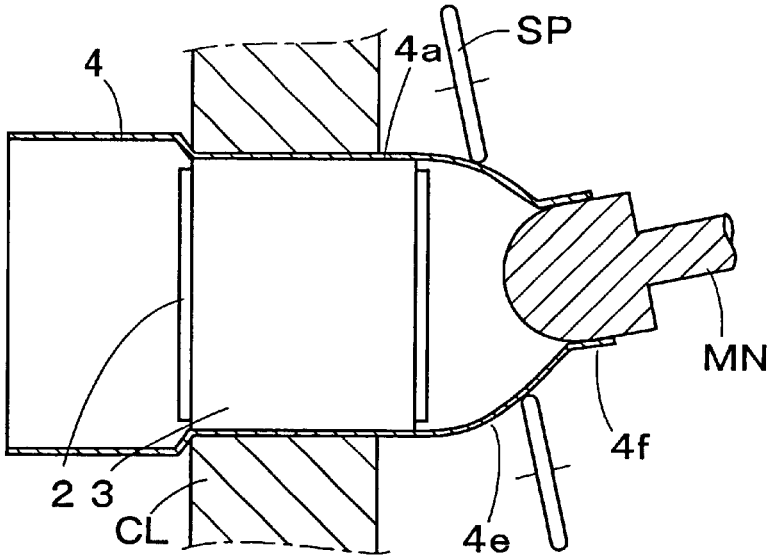
FIG. 18 is a sectional view showing a spinning process to an end portion having an inclined axis in the method according to an embodiment of the present invention.

FIG. 18 shows another embodiment of the necking process in the present invention, wherein the mandrel (MN) is positioned in such a manner that its axis is oblique to the axis of the cylindrical housing 4, to which the necking process is applied by the spinning rollers (SP), instead of the processes as shown in FIGS. 16 and 17. In this case, the clamp device (CL) is required not to interfere with the spinning rollers (SP). As a result, the tapered portion 4*e* and bottle neck portion 4*f* having the axis oblique to the axis of the reduced diameter portion 4*a* can be formed on the other end portion of the cylindrical housing 4 as shown in FIG. 18. Or, there may be formed the tapered portion 4*e* and bottle neck portion 4*f* having an axis offset to the axis of the reduced diameter portion 4*a*. Furthermore, the necking process can be applied to the opposite ends of the cylindrical housing 4, in accordance with a combination of axes coaxial with, oblique to, and offset from the axis of the reduced diameter portion 4*a*. As for the spinning apparatus for use in the present embodiment, the one as disclosed in Japanese Patent Laid-open Publication No. 2001-137962 is appropriate.

According to the present embodiment, therefore, the cylindrical housing 4 is not rotated during the spinning process, a structure for certainly holding the cylindrical housing 4 can be easily constituted. And, the catalyst substrate 2 and the shock absorbent mat 3 accommodated in the cylindrical housing 4 are not rotated about the longitudinal axis during the spinning process, the stable holding state can be maintained. As the necking process can be applied to the opposite ends of the cylindrical housing 4 consecutively, the working time in total will be reduced, comparing with the prior method. According to the present embodiment, with the necking process performed by the plurality of spinning rollers (SP), the bottle neck portion 4*c* is formed to be smoothly integrated with the reduced diameter portion 4*a*. Especially, in the case where the step portion 4*d* (shown in FIG. 16) was formed between the body portion (reduced diameter portion 4*a*) of the cylindrical housing 4 and the opposite ends thereof when the cylindrical housing 4 was shrinked, the step portion 4*d* can be removed by the spinning rollers (SP), whereby the continuously smooth surface from the body portion to the neck portion can be formed.

Figure 19:
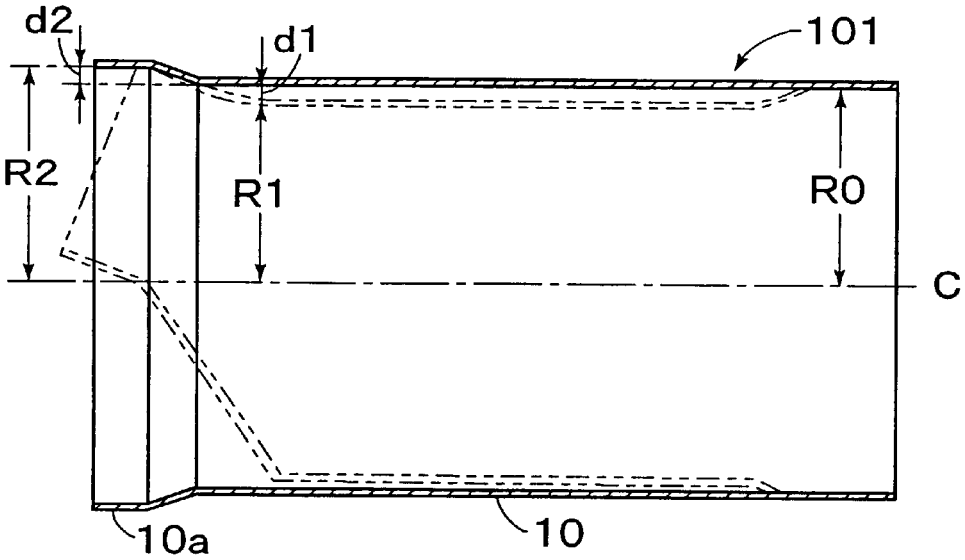
FIG. 19 is a sectional view showing a primary workpiece with an enlarged portion formed on one end of a cylindrical housing, in the method for producing a catalytic converter according to another embodiment of the present invention.

Referring to FIGS. 19–26, another embodiment of the present invention will be explained hereinafter. First of all, determined is a maximum inner diameter (R2) of an end portion formed in its final target shape of a metallic cylindrical housing, with its unformed portion indicated by "10" in FIG. 19. A cylindrical housing with an enlarged portion formed on its one end is named as a primary workpiece and indicated by "101" in FIG. 19. That is, the maximum inner diameter (R2) is determined by a distance between the central axis (C) of the body portion and the inner surface of one end potion with its final target shape extending outward of a virtually extending surface from the outer peripheral surface of the body potion (indicated by two-dot chain line in FIG. 19) of the cylindrical housing 10. Then, one end potion of the cylindrical housing is enlarged in diameter up to the maximum inner diameter (R2) of its final target shape, to form an enlarged diameter portion 10*a*. Hereinafter, the cylindrical housing with the enlarged diameter portion 10*a* is identified as the primary workpiece 101. As for a process (or means) for enlarging the diameter in this embodiment, may be used a press working process generally by stuffing a punch into the housing, a spinning process, or the like. The enlarged amount of diameter (d2) resulted from the enlarging diameter process as described above, corresponds to a value subtracted from the maximum inner diameter (R2) of the final target shape by the inner radius (R0) of the cylindrical housing (the portion thereof before working). The diameter (R1) as shown in FIG. 19 corresponds to the target radius (Rt) as shown in FIG. 3, and (d1) indicates a reduced amount of diameter. In other words, the diameter (R1) is obtained in the same manner as the target radius (Rt), as described before, and the diameter (R1) is subtracted from the inner radius (R0) of the cylindrical housing to produce the reduced amount of diameter (d1).

In FIG. 19, the position indicated by the two-dot chain line corresponds to the position which is away from the central axis (C) by the distance (R1), which is set for the inner diameter of the final target shape of the body portion 11 in FIG. 22, which shows the necking process applied to the end portion of the cylindrical housing later. Therefore, the difference between the inner diameter (R1) of the final target shape of the body portion 11 in FIG. 22 and the maximum inner diameter (R2) of the enlarged diameter portion 10*a* (i.e., d0=R2−R1) is the maximum width extending outward of the virtually extending surface from the outer peripheral surface of the body potion 11, to result in the relationship of d0=d1+d2. In other words, although the deformed amount by enlarging the one end of the cylindrical housing is only the enlarged amount of diameter (d2) as shown in FIG. 19, the deformed amount (d0) will be finally provided for the outer peripheral surface of the body potion 11. That is, as the difference between the maximum inner diameter (R2) of the final target shape of one end of the cylindrical housing (i.e., the enlarged diameter portion 10*a* in FIG. 19) and the inner diameter (R1) of the final target shape of the body portion 11 with the shrinking process applied thereto (i.e., the reduced diameter portion) equals the maximum width (d0) extending outward of the virtually extending surface from the outer peripheral surface of the body potion 11, the deformed amount by the diameter enlarging process and diameter decreasing process can be minimized. Furthermore, the measurement process as described before may be simplified by using a result of measuring a sample, without measuring every product, as far as the catalyst substrate 2 and shock absorbent mat 3 are capable of maintaining their qualities with allowable errors, respectively.

Figure 20:
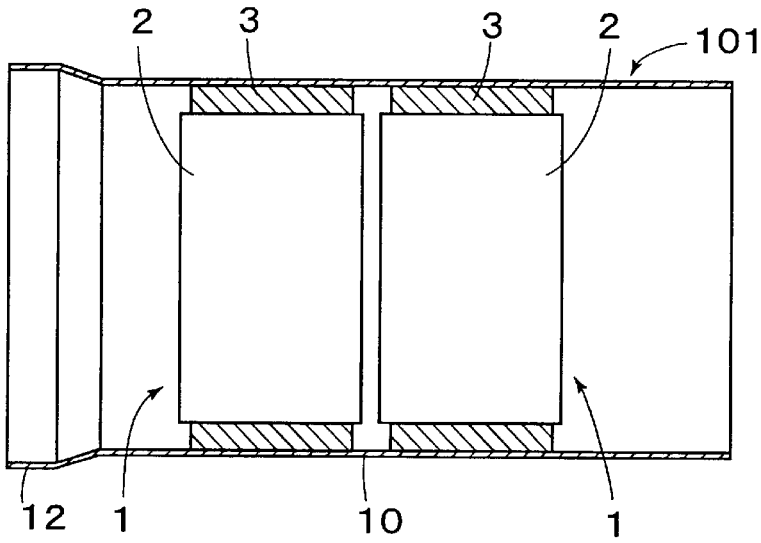
FIG. 20 is a sectional view showing a state of inserting a united product with a catalyst substrate and a shock absorbent mat wrapped around it into a primary workpiece, in the method for producing a catalytic converter according to another embodiment of the present invention.

Then, as shown in FIG. 20, a couple of united products 1 of the catalyst substrate 2 and the shock absorbent mat 3 wrapped around it are inserted into the primary workpiece 101 with the enlarged portion formed on one end of the cylindrical housing as shown in FIG. 19, and placed in parallel with each other, to be held at the predetermined positions, respectively. In this process, it is preferable to arrange such that the outer surface of each shock absorbent mat 3 is not compressed by the inner surface of the cylindrical housing, and does not contact it, or may contact it softly, so that each shock absorbent mat 3 will be applied with almost no compressing force. The diameter enlarging process as shown in FIG. 19 and the inserting process as shown in FIG. 20 may be reversed. Or, the measurement process may be performed before the inserting process.

Figure 21:
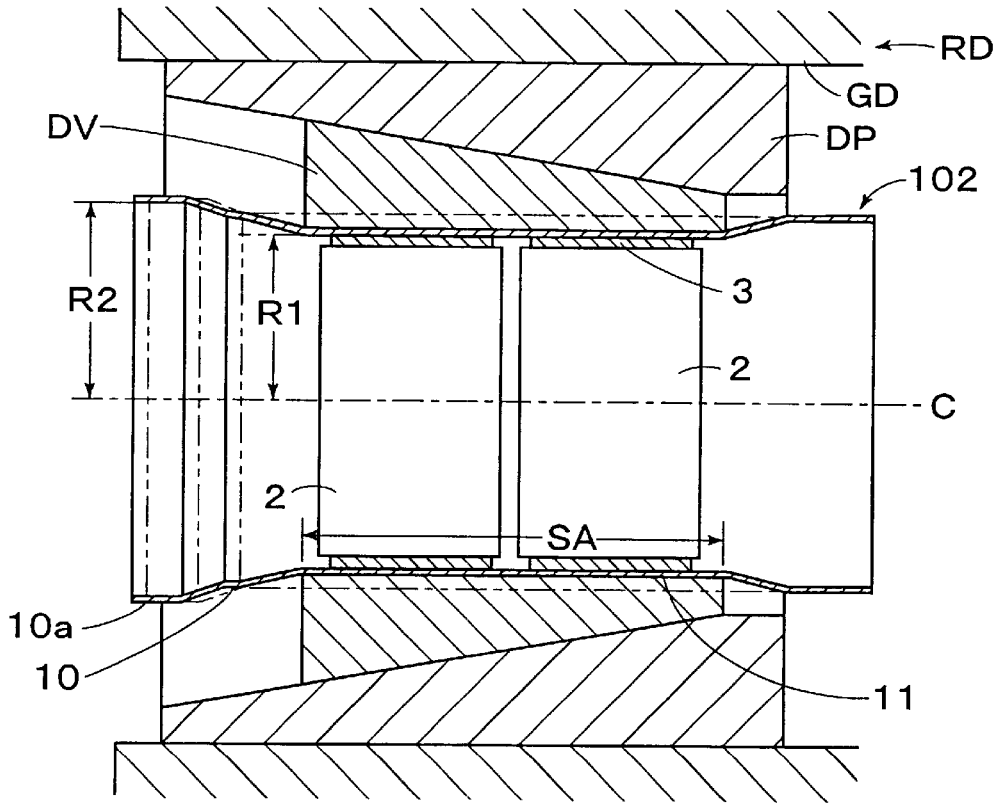
FIG. 21 is a sectional view showing a state of shrinking a primary workpiece in a sizing process according to another embodiment of the present invention.

Next, the sizing process is applied to the primary workpiece 101 with the united product accommodated therein and placed at a predetermined position, as shown in FIG. 21, to shrink the nonworking portion (i.e., the body portion of the cylindrical housing) until the shock absorbent mat 3 is compressed to provide the most appropriate compressed amount. Among various sizing processes, the shrinking device (RD) as shown in FIG. 10 is used in the present embodiment. Accordingly, the sizing process is achieved to produce a secondary workpiece 102 in FIG. 21 in the same manner as described before, and therefore further explanation is omitted herein.

Figure 22:
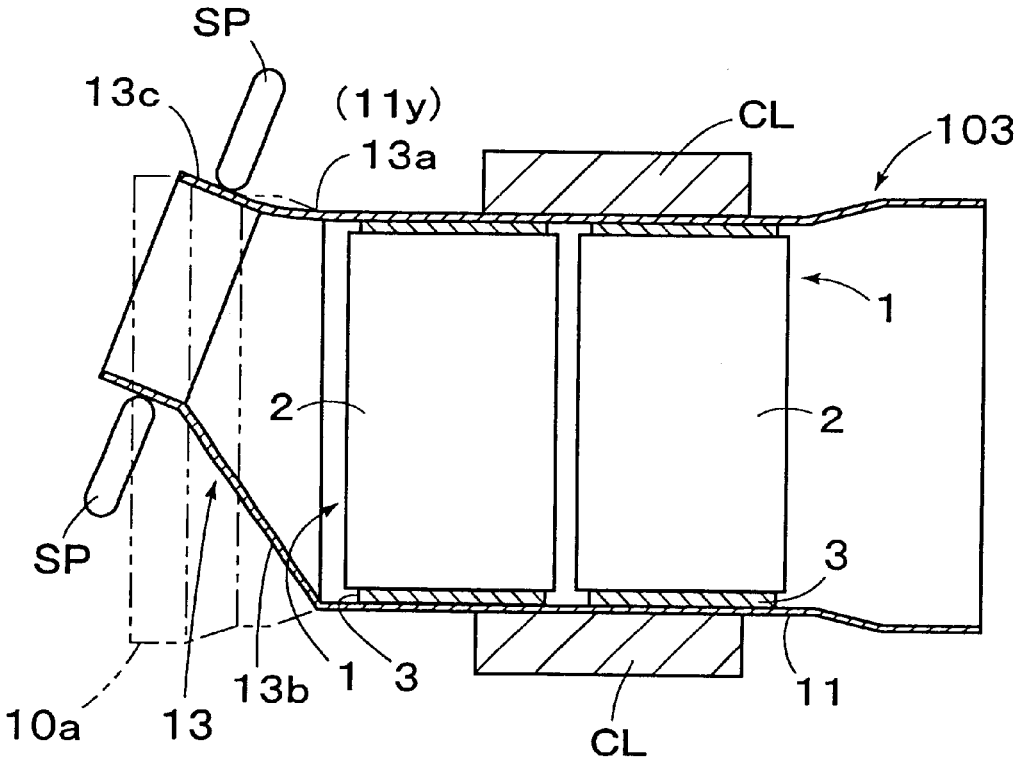
FIG. 22 is a sectional view showing a state of applying a necking process by spinning rollers to an end portion of a secondary workpiece according to another embodiment of the present invention.
Figure 23:
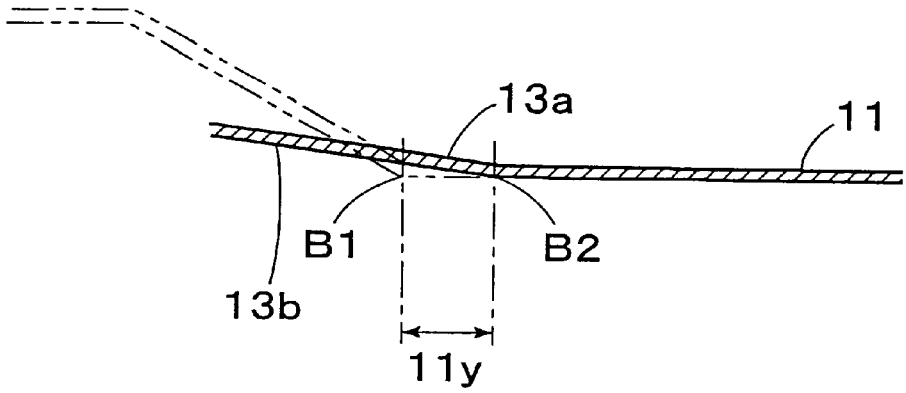
FIG. 23 is a sectional view enlarging a portion in the vicinity of the upper left end of a body portion as shown in FIG. 22.

After the sizing process, the necking process is applied by the spinning rollers (SP) to an end portion of the secondary workpiece 102, as shown in FIG. 22. At the outset, the body portion of the secondary workpiece 102 is clamped by the clamp device (CL) for the spinning apparatus (not shown), not to be rotated, and not to be moved axially. And, a plurality of target working portions (not shown) are provided to form a necking portion 13 that includes a final target working portion (tapered portion 13*b* and neck portion 13*c* as shown in FIG. 22), which has a central axis with a relationship with one of oblique to, offset from, and skewed from the central axis ("C" in FIG. 21) of the body potion 11, and a portion of which extends outward of the virtually extending surface from the outer peripheral surface of the body potion 11. In this case, as shown in FIG. 23, which enlarges a section in the vicinity of the upper left end of FIG. 22, the necking portion 13 is adapted to be formed so as to include a predetermined area 11*y* at the left end of the body portion 11. That is, the necking process is applied by the spinning rollers (SP) to the predetermined area 11*y* (the area as indicated by one-dot chain lines in FIG. 23) of the body potion 11, so that a section covering the area 11*y* constitutes a part of the necking portion 13 to form an overlapped working portion 13*a* as indicated by a solid line in FIG. 23.

Then, a plurality of working target axes (not shown) are provided on the basis of the plurality of target working portions. And, the secondary workpiece 102 as shown in FIG. 21 is held so that the central axis (not shown) of the enlarged diameter portion 10*a* will be placed substantially on the same axis as one of the plurality of working target axes. Then, the spinning process is applied to its end portion by means of a plurality of spinning rollers (SP), which are revolved about the axis of the end portion along a common circular locus. That is, the spinning rollers (SP), which are positioned around the outer periphery of the end portion of the secondary workpiece 102, preferably with an equal distance spaced between the neighboring rollers, are pressed onto the outer surface of the end portion of the secondary workpiece 102, and revolved about the axis thereof, and moved along the axis (to the left in FIG. 22), with a revolutionary locus reduced, to achieve the spinning process. Accordingly, as shown in FIG. 22, is formed a third workpiece 103, one end of which is formed into the necking portion 13 with the oblique axis to provide the final target shape.

Figure 24:
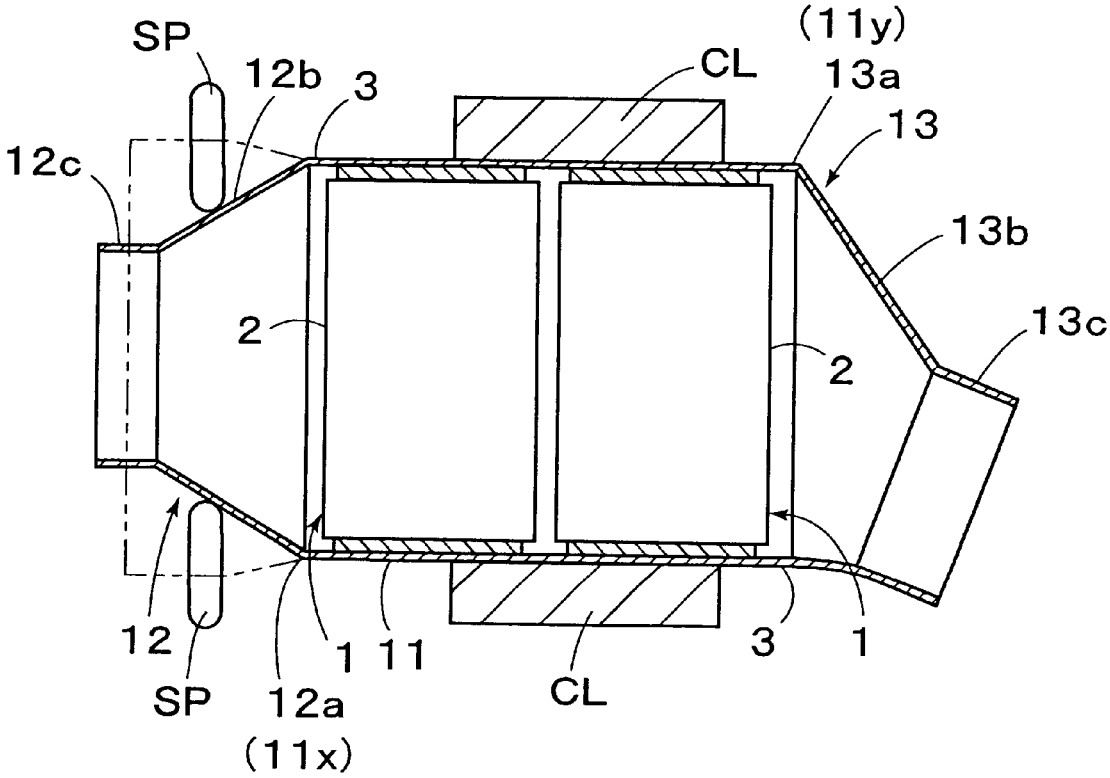
FIG. 24 is a sectional view showing a state of applying a necking process by spinning rollers to an end portion of a third workpiece with one end portion formed a necking portion, according to another embodiment of the present invention.
Figure 25:
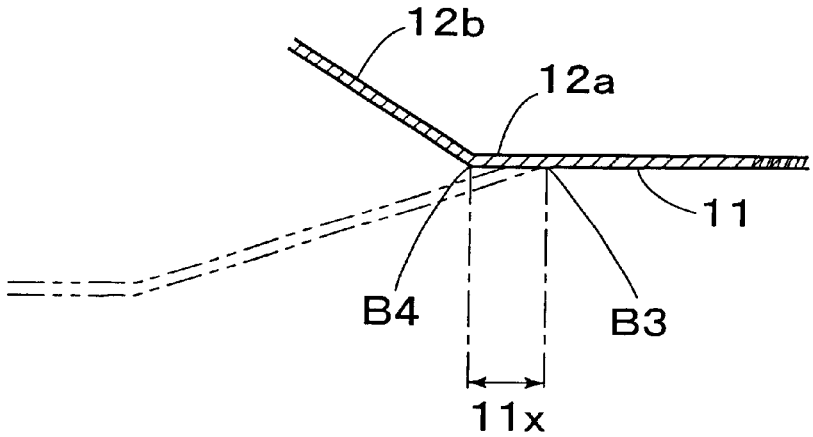
FIG. 25 is a sectional view enlarging a portion in the vicinity of the lower left end of a body portion as shown in FIG. 24.

Referring next to FIG. 24, the third workpiece 103 with the necking portion 13 formed thereon (as shown in FIG. 22) is reversed by 180 degree, and positioned as shown in FIG. 24, so that the necking process is performed by means of the spinning rollers (SP) with respect to the other one end portion, as well. The reversing operation of the third workpiece 103 is performed after the necking process to form the necking portion 13. That is, the third workpiece 103 is released from the clamp device (CL), and reversed by a robot hand (not shown), and then clamped again by the clamp device (CL). Then, the body portion 11 of the third workpiece 103 is clamped again by the clamp device (CL), and the other one end portion is formed by the spinning rollers (SP) to form a necking portion 12 with a tapered portion 12*b* and neck portion 12*c* on the same axis as the central axis ("C" in FIG. 21) of the body portion 11, as shown in FIG. 24. In this case, as shown in FIG. 25, which enlarges a section in the vicinity of the lower left end of FIG. 24, the necking portion 12 is adapted to be formed so as to include a predetermined area 11*x* at the left end of the body portion 11. That is, the necking process is applied by the spinning rollers (SP) to the predetermined area 11*x* (the area as indicated by one-dot chain lines in FIG. 25) of the body potion 11, a section covering the area 11*x* constitutes a part of the necking portion 12 to form an overlapped working portion 12*a* as indicated by a solid line in FIG. 25.

According to the present embodiment, the secondary workpiece 102 (or, the third workpiece 103) is not rotated during the spinning process, a structure for holding the secondary workpiece 102 can be easily constituted. And, the catalyst substrate 2 and the shock absorbent mat 3 accommodated in the secondary workpiece 102 (or, the third workpiece 103) are not rotated about the longitudinal axis during the spinning process, the stable holding state can be maintained. And, the necking process can be easily applied to each of the secondary workpiece 102 and third workpiece 103, consecutively. Particularly, according to the present embodiment, with the necking process applied by the spinning rollers (SP) to the predetermined areas 11*x* and 11*y* of the body portion 11, the portions corresponding to the areas 11*x* and 11*y* will constitute a part of the necking portions 12 and 13, to provide the overlapped working portions 12*a* and 13*a*. In this case, the necking portion 13 is formed by the oblique spinning process. In this process, as the spinning rollers (SP) are revolved on the surface oblique to the axis of the cylindrical housing, it is preferable that the overlapped working portion 13*a* is made wider than the overlapped working portion 12*a* which is formed by the co-axial spinning process. The same is true of the offset spinning process.

With respect to the necking portion 13, the necking process is performed as shown in FIG. 23, starting from a bent portion B2 which is different from a bent portion B1 formed in the sizing process, to provide the overlapped working portion 13*a*, so that the bent portions will not be overlapped. Furthermore, the bent portion B1 formed in the sizing process is reformed into the one of an even thickness as a whole, with a positive plastic flow of the material caused by the spinning process in the helical direction. Likewise, with respect to the necking portion 12, the necking process is performed, starting from a bent portion B3 which was formed in the sizing process to the body portion 11, to be bent at a bent portion B4 which is different from the bent portion B3, so that the bent portions will not be overlapped. And, the bent portion B4 is reformed into the one of an even thickness as a whole, with the positive plastic flow of the material caused by the spinning process in the helical direction, as well.

Consequently, a catalytic converter C1 is formed as shown in FIG. 26, to provide a plurality of parallel traces lie formed on the outer surface of the body portion 11 by the sizing process to a predetermined area (SA), and a plurality of streaks 12*j* and 13*j* formed on the outer surface of the necking portions 12 and 13 by the spinning process to a predetermined area (SA). As indicated by broken lines in FIG. 26, the opposite ends of the traces 11*e* formed in the shrinking process are disappeared when the necking portions 12 and 13 are formed, and the remaining portions of the traces 11*e* are connected at their opposite ends to the streaks 12*j* and 13*j* to be perpendicular thereto. The traces lie as described above are resulted from such a specific process as using the shrinking device (RD) as shown in FIG. 10. The lines indicative of the traces 11*e* as shown in FIG. 26 were emphasized for the sake of better understanding, while they are not so much noticeable, in fact. Preferably, they can not be noticed by eyes. The same is true of the streaks 12*j* and 13*j* formed by the spinning process.

Figure 27:
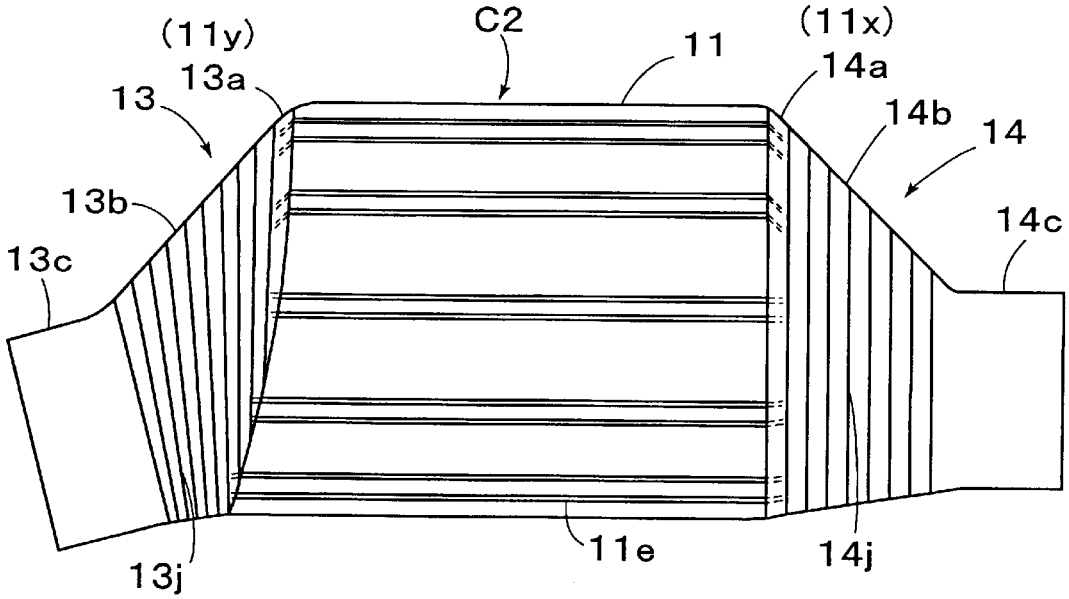
FIG. 27 is a side view showing another example of a finished catalytic converter produced according to an embodiment of the present invention.

The oblique spinning process as disclosed in Japanese Patent No. 2957154 (corresponding to the U.S. Pat. No. 6,067,833) was applied to the one end of the secondary workpiece 102. Alternatively, the offset spinning process as disclosed in Japanese Patent No. 2957153 (corresponding to the U.S. Pat. No. 6,018,972) may be applied to the one end of the secondary workpiece 102, to form a catalytic converter C2 having an offset necking portion 14, as shown in FIG. 27. With respect to the sizing process, the spinning rollers (SP) may be used for sizing the body portion of the cylindrical housing as disclosed in Japanese Patent Laid-open Publication No. 2001-107725 (corresponding to the U.S. Pat. No. 6,381,843).

Next will be explained a further embodiment, wherein a pressure sensor element (SS) is disposed between the catalyst substrate 2 and the shock absorbent mat 3, as indicated by broken lines in FIG. 2, and the pressure applied to the catalyst substrate 2 is detected directly on the basis of the signal sensed by the pressure sensor element (SS). As for the pressure sensor element (SS), there is put on the market a sensor for detecting a pressure distribution at real time by an elongated sensor sheet with electrodes disposed thereon. For example, the sensor sheet (called as "MATSCAN") is sold by Tekscan, Inc. in the U.S.A., and a pressure distribution measuring system (called as "I-SCAN") is sold by NITTA Co., Ltd. in Japan. Therefore, the elongated sensor sheet capable of sensing the area compressed by the elongated pushing members (PMx) as described before may be placed on the catalyst substrate 2, to constitute the pressure sensing device. As a result, the body portion of the cylindrical housing 4 accommodated therein the shock absorbent mat 3 can be shrinked together with the shock absorbent mat 3, controlling the pressure (Ps) within a predetermined pressure range to hold the catalyst substrate 2, without measuring the aforementioned distance (Ds) by the measuring device (DT) and without determining the target radius (Rt).

According to the present embodiment as described above, therefore, the pressure sensing element (SS) is used for a sensing device for detecting the pressure applied to the catalyst substrate 2 as the columnar member, and a compression device such as the shrinking device (GD) as shown in FIG. 10 is provided for inserting the catalyst substrate 2 (columnar member) with the shock absorbent mat 3 (shock absorbent member) wrapped around it together with pressure sensing element (SS) smoothly into the cylindrical housing 4, and compressing a body portion of the cylindrical housing 4 covering at least the shock absorbent mat 3. And, a control device (e.g., controller (CT) in FIG. 3) is provided for actuating the compression device to such an extent that the pressure exerted on the catalyst substrate 2 (columnar member) is controlled to be within a predetermined pressure range by the pressure restoring force of the shock absorbent mat 3, to reduce a diameter of the body portion of the cylindrical housing 4 together with the shock absorbent mat 3. Consequently, by means of the shrinking device (GD) as shown in FIG. 10, the catalyst substrate 2 with the shock absorbent mat 3 wrapped around it can be inserted smoothly into the cylindrical housing 4, and a body portion of the cylindrical housing 4 covering at least the shock absorbent mat 3 can be compressed so that the pressure exerted on the catalyst substrate 2 by the pressure restoring force of the shock absorbent mat 3 will be within the predetermined pressure range, to hold the catalyst substrate 2. Therefore, the processes from the measurement process to the sizing process can be performed consecutively by the single device, to reduce the manufacturing time largely. If the pressure sensing element (SS) is inexpensive and does not affect the function of the catalytic converter, it may be left in the cylindrical housing 4 as it is, without being removed from it after the sizing process.

Furthermore, on an end surface of the catalyst substrate 2 as indicated by broken lines in FIG. 2, may be attached an IC tag (TG) to provide various producing systems. The IC tag (TG) is a tag member with a known identification tag made of a writable and readable IC tip and a transmittable small antenna embedded therein. Usually, the IC tag (TG) is adapted to receive a wave from a writer or reader and convert it into electric power for energizing a CPU, and emit a wave for exchanging data. Any type of the IC tag on the market may be used, as far as the data can be exchanged through it without any holding electric power, while it may be of several millimeters square shape and thickness, preferably. Alternatively, it may be of other types such as IC card, as far as it functions as the memory and communication means. Any propagated distance of wave may be set to provide a close type, near-by type, neighborhood type, remote type and the like, or may be used a contact type without exchanging data through wave. All of those are named herein as the IC tag.

As a first producing system, at the outset, a product number, substrate information and manufacturer's identification of the catalyst substrate 2 are written in advance on a non volatile memory of the IC tag (TG). Next, the shock absorbent mat 3 is wrapped around the catalyst substrate 2, and the aforementioned measurement is performed. The measured data including the target radius (Rt) for producing the most appropriate pressure or the like, and the measurer's identification are written further on the IC tag (TG). Then, in the sizing process, the sizing is made in accordance with the information of ID and working conditions written on the IC tag (TG). After the requisite working was achieved, the IC tag (TG) is removed from the catalyst substrate 2, and the finished product (catalytic converter) is delivered. In this case, even if a company for manufacturing the catalyst substrate 2 and fixing the IC tag (TG) on it, a company for wrapping the shock absorbent mat 3 around the catalyst substrate 2 and performing the measurement to write further on the IC tag (TG), and a company for performing the sizing process on the basis of the information stored in the IC tag (TG) are different from one another, the product can be formed certainly into the one with the target radius (Rt). These exchanged information may be made automatically exchangeable through internet or the like among those companies any time when required, whereby a series of processes of determining the progress, preparing for each process, and even for a physical distribution management can be performed smoothly.

Alternatively, as a second producing system, at the outset, the shock absorbent mat 3 is wrapped around the catalyst substrate 2, and the aforementioned measurement is performed. At this time, the product number, substrate information, manufacturer's identification of the catalyst substrate 2, the measured data including the target radius (Rt) for producing the most appropriate pressure or the like, and the measurer's identification are written on the IC tag (TG). Next, in the sizing process, the sizing is made in accordance with the information written on the IC tag (TG). After the requisite working was achieved, the IC tag (TG) is removed from the catalyst substrate 2, and the finished product (catalytic converter) is delivered. That is, the product is produced by two companies of the one company for manufacturing the catalyst substrate 2, then wrapping the shock absorbent mat 3 around the catalyst substrate 2 and performing the measurement, and then fixing the IC tag (TG) on it, and the other one company for performing the sizing process on the basis of the information stored in the IC tag (TG). In this case, the product can be formed certainly into the one with the target radius (Rt), as well.

In the case where all of the processes are achieved by a single company, if the IC tag (TG) is used as described above, it will be effective especially in the case where each process is required to be performed at places remote in distance or time. Furthermore, the finished product (catalytic converter) may be delivered, in a state with the IC tag (TG) fixed to the product, so that the IC tag (TG) will be burnt off when the catalytic converter is tested at a vehicle manufacturer. Thus, by using the IC tag (TG), not only the sizing process can be achieved appropriately on the basis of the measured result obtained in the preceding process, but also many other effects such as preventing the erroneous assembling, tracing the physical distribution, investigating problems on the processes and improving them, and so on can be expected.

According to each embodiment as described above, the catalyst substrate 2 has a circular cross section, which is an example of many embodiments having various cross sections, including an elliptic cross section, oval cross section, and cross section with various radiuses of curvature combined, and non-circular cross sections such as polygonal cross section. The cross sectional shape of each cell is not limited to the honeycomb (hexagon), but any shape such as square may be employed. Although the number of the catalyst substrate 2 was one or two according to the embodiments as described above, more than two substrates may be aligned. Furthermore, the shrinking process may be applied to every portion of the housing covering each catalyst substrate, or may be applied to the entire housing continuously. And, the process and apparatus as described above may be adapted to produce the finished products of not only the exhaust parts for automobiles, but also various fluid treatment devices including a reformer for use in a fuel cell system.

It should be apparent to one skilled in the art that the above-described embodiments are merely illustrative of but a few of the many possible specific embodiments of the present invention. Numerous and various other arrangements can be readily devised by those skilled in the art without departing from the spirit and scope of the invention as defined in the following claims.

What is claimed is:

1. A method of producing a container for holding a columnar member in a cylindrical housing with a shock absorbent member wrapped around the columnar member, comprising:

compressing at least a part of the shock absorbent member wrapped around the columnar member, by a pushing member in a radial direction toward a longitudinal axis of the columnar member;

measuring a pressure applied to the shock absorbent member by the pushing member;

measuring a distance between the axis of the columnar member and an end of the pushing member contacting the shock absorbent member, when the measured pressure substantially equals a predetermined target pressure, to provide a target radius;

inserting the columnar member with the shock absorbent member wrapped around the columnar member, into the cylindrical housing loosely; and reducing a diameter of at least a part of the cylindrical housing with the shock absorbent member held therein along the longitudinal axis of the cylindrical housing, with the shock absorbent member being compressed, to such an extent that the inner radius of the part of the cylindrical housing substantially equals the target radius, to hold the columnar member with the shock absorbent member wrapped around the columnar member and compressed at the target pressure, in the cylindrical housing.

2. The method of claim 1, wherein the target pressure is determined on the basis of a static coefficient of friction of the outer surface of the columnar member, and a static coefficient of friction of the inner surface of the cylindrical housing, and pushing force of the pushing member applied to the shock absorbent member.

3. The method of claim 1, wherein a plurality of pushing members are placed around the periphery of the columnar member in parallel with the longitudinal axis thereof, and wherein at least one of the pushing members compresses the shock absorbent member wrapped around the columnar member in the radial direction toward the longitudinal axis of the columnar member, to measure the pressure applied to the shock absorbent member.

4. The method of claim 3, wherein the plurality of pushing members comprise a plurality of elongated members, each having a length corresponding to the part of the cylindrical housing with the shock absorbent member held therein, and wherein the plurality of elongated members are placed in parallel with one another around the periphery of the shock absorbent member wrapped around the columnar member.

5. The method of claim 4, wherein the columnar member wrapped with the shock absorbent member in an intermediate state thereof between the compressed state by the pushing member and the original state released from the pushing force applied by the pushing member, is inserted into the cylindrical housing.

6. The method of claim 4, wherein the plurality of elongated members placed in parallel with one another around the periphery of the shock absorbent member reduces the diameter of the cylindrical housing with the shock absorbent member held therein, with the shock absorbent member being compressed, to the extent that the inner radius of at least the part of the cylindrical housing substantially equals the target radius.

7. The method of claim 1, wherein a predetermined amount of correction is provided on the basis of at least one of a change in diameter and a change in thickness of the cylindrical housing when the diameter of the cylindrical housing is reduced, and wherein the reducing amount of the cylindrical housing is adjusted according to the amount of correction, when the diameter of the cylindrical housing with the shock absorbent member held therein is reduced.

8. The method of claim 7, wherein the amount of correction is provided by measuring a limit radius of the cylindrical housing, when the shock absorbent member is compressed by the pushing member to such an extent that the inner radius of at least the part of the cylindrical housing is reduced to be less than the target radius and immediately before the columnar member will be fractured, and setting a predetermined distance less than a difference between the limit radius and the target radius, as the amount of correction.

9. The method of claim 1, further comprising:

determining an inner diameter of a final target shape provided for at least an end portion of the cylindrical housing, on the basis of the measured distance between the axis of the columnar member and the end of the pushing member contacting the shock absorbent member, when the measured pressure substantially equals the predetermined target pressure;

enlarging the inner diameter of the end portion to form an enlarged diameter portion with a predetermined maximum inner diameter;

providing a plurality of target working portions having a central axis with a relationship with one of oblique to, offset from, and skewed from the central axis of a body portion of the cylindrical housing, and extending to an outer peripheral surface of the enlarged diameter portion;

providing a plurality of working target axes on the basis of the plurality of target working portions;

holding the cylindrical housing to place the central axis of the enlarged diameter portion substantially on the same axis as one of the plurality of working target axes; and spinning at least the enlarged diameter portion, with the central axis of the enlarged diameter portion placed on each of the plurality of working target axes, to reduce a diameter of the enlarged diameter portion at each of the plurality of working target axes, and form a necking portion of the final target shape.

10. The method of claim 9, wherein the necking portion is formed by spinning the body portion from at least an end portion thereof including a predetermined area thereof to an open end of the cylindrical housing, along the working target axis with a relationship with the central axis of the body portion, the relationship being one of oblique to, offset from, and skewed from the central axis.

11. The method of claim 9, wherein the predetermined maximum inner diameter is determined by a distance between the central axis of the body portion and the inner surface of the end portion with the final target shape thereof extending outward of a virtually extending surface from the outer peripheral surface of the body portion.

12. An apparatus for producing a container for holding a columnar member in a cylindrical housing with a shock absorbent member wrapped around the columnar member, comprising:

compression means having a plurality of elongated pushing members, each having a length corresponding to at least a part of the cylindrical housing with the shock absorbent member held therein, and being placed in parallel with one another around the periphery of the shock absorbent member wrapped around the columnar member, and compressing at least the part of the shock absorbent member wrapped around the columnar member, by the pushing members in a radial direction toward a longitudinal axis of the columnar member;

measurement means for measuring a pressure applied to the shock absorbent member by the pushing members, and measuring a distance between the axis the columnar member and an end of at least one of the pushing members contacting the shock absorbent member, when the measured pressure substantially equals a predetermined target pressure, to provide a target radius; and control means for inserting the columnar member with the shock absorbent member wrapped around the columnar member into the cylindrical housing loosely, and driving the compression means to reduce a diameter of at least the part of the cylindrical housing with the shock absorbent member held therein along the longitudinal axis of the cylindrical housing, by the pushing members, to such an extent that the inner radius of the part of the cylindrical housing substantially equals the target radius, to hold the columnar member with the shock absorbent member wrapped around the columnar member and compressed at the target pressure in the cylindrical housing.

13. The apparatus of claim 12, wherein the control means is adapted to provide a predetermined amount of correction on the basis of at least one of a change in diameter and a change in thickness of the cylindrical housing when reducing the diameter of the cylindrical housing, and adjust the reducing amount of the cylindrical housing according to the amount of correction, when reducing the diameter of the cylindrical housing with the shock absorbent member held therein.

14. The apparatus of claim 13, wherein the measurement means is adapted to provide the amount of correction by measuring a limit radius of the cylindrical housing, when compressing the shock absorbent member by the pushing members to such an extent that the inner radius of at least the part of the cylindrical housing is reduced to be less than the target radius and immediately before the columnar member will be fractured, and setting a predetermined distance less than a difference between the limit radius and the target radius, as the amount of correction.

15. The apparatus of claim 12, wherein the plurality of elongated pushing members include T-slots.

16. The apparatus of claim 12, wherein the compression means further comprises a cylindrical shrinking device surrounding said plurality of elongated pushing members.

17. The apparatus of claim 12, wherein the apparatus holds a plurality of columnar members in a cylindrical housing with a plurality of shock absorbent members around the columnar members.

18. The apparatus of claim 12, wherein the cylindrical housing includes an overlapped working portion extending beyond an upper and a lower extremity of the columnar member.

19. The apparatus of claim 12, wherein the cylindrical housing includes a plurality of parallel traces.

* * * * *